United States Patent [19]

Smothers et al.

[11] Patent Number: 4,719,839

[45] Date of Patent: Jan. 19, 1988

[54] ROTARY STORAGE MAGAZINE

[75] Inventors: Paul W. Smothers; James M. Coryell; Frederick I. Maish, all of Orlando, Fla.

[73] Assignee: Werkzeugmaschinenfabrik, Zurich, Switzerland

[21] Appl. No.: 701,610

[22] Filed: Feb. 14, 1985

[51] Int. Cl.[4] ..... F41F 9/08; B65G 1/04; B65G 25/04

[52] U.S. Cl. ..... 89/1.802; 414/609; 414/745; 414/911

[58] Field of Search ..... 89/1.8, 1.801, 1.802, 89/1.805, 1.815, 1.816, 1.819, 36.08; 414/609, 610, 612, 745, 911

[56] References Cited

U.S. PATENT DOCUMENTS

| | | | |
|---|---|---|---|
| 2,785,607 | 3/1957 | Henstrom et al. | 89/36.08 |
| 2,908,200 | 10/1959 | Linke | 89/1.7 |
| 2,966,996 | 1/1961 | Friend | 414/612 |
| 3,113,486 | 12/1963 | Kongelbeck | 89/1.7 |
| 3,228,295 | 1/1966 | Kane et al. | 89/1.802 |
| 3,245,317 | 4/1966 | Matson et al. | 89/1.7 |
| 3,249,011 | 5/1966 | Wermager et al. | 89/1.7 |
| 3,280,702 | 10/1966 | Hereth et al. | 89/1.805 |
| 3,316,808 | 5/1967 | Mais | 89/1.816 |
| 3,331,279 | 7/1967 | Aldrin et al. | 89/1.802 |
| 3,376,785 | 4/1968 | Elwin | 89/46 |
| 3,754,497 | 8/1973 | Rusbach | 89/1.814 |
| 3,974,737 | 8/1976 | Georgel et al. | 89/1.802 |
| 4,010,672 | 3/1977 | Kolbinger et al. | 89/1.802 |
| 4,128,039 | 12/1978 | Skliris | 89/1.803 |

FOREIGN PATENT DOCUMENTS

| | | |
|---|---|---|
| 1481365 | 4/1969 | Fed. Rep. of Germany . |
| 2543285 | 9/1984 | France . |

OTHER PUBLICATIONS

Weartechnik, No. 11, Nov. 1981, pp. 98–99, Bonn, De.
Soldat und Technik, vol. 19, No. 6, 1976, pp. 286–287.
Cornett et al., article entitled "Part of the Battlefield of the Future" *National Defense,* 10–1983, pp. 24–31.

*Primary Examiner*—Frederick R. Schmidt
*Assistant Examiner*—William E. Terrell
*Attorney, Agent, or Firm*—Julian C. Renfro

[57] ABSTRACT

A rotary storage magazine located immediately below the level of the deck of a vehicle or structure, usable such that munitions may be stored and thereafter quickly delivered on an as-needed basis to an intermediate position for the reloading of a weapon. This intermediate position can be on the deck, alongside the weapon to be reloaded, or else outboard of the weapon. Our rotary storage magazine comprises fore and aft rotary support devices disposed immediately below deck level a spaced distance apart, which distance is less than the length of the munitions to be stored. The rotary support devices each have a plurality of support arms, such that munitions disposed in a generally parallel array may be cradled between corresponding support arms of the fore and aft rotary support devices. The rotary support devices have a common axis of rotation, and we provide electric power for driving these devices in one rotative direction during the loading of munitions into the storage magazine, and for driving these devices in the opposite direction during the delivery of the munitions to the vehicle's deck level. Releasable restraint arms on the support arms of the rotary support devices prevent dislodgment of the munitions during rotation of the rotary support devices. In the preferred embodiment, an elevator operational in timed relation to the rotary support devices and located therebetween serves as a munitions transporter that accomplishes the ready loading as well as the rapid unloading of munitions from the rotary storage magazine.

45 Claims, 29 Drawing Figures

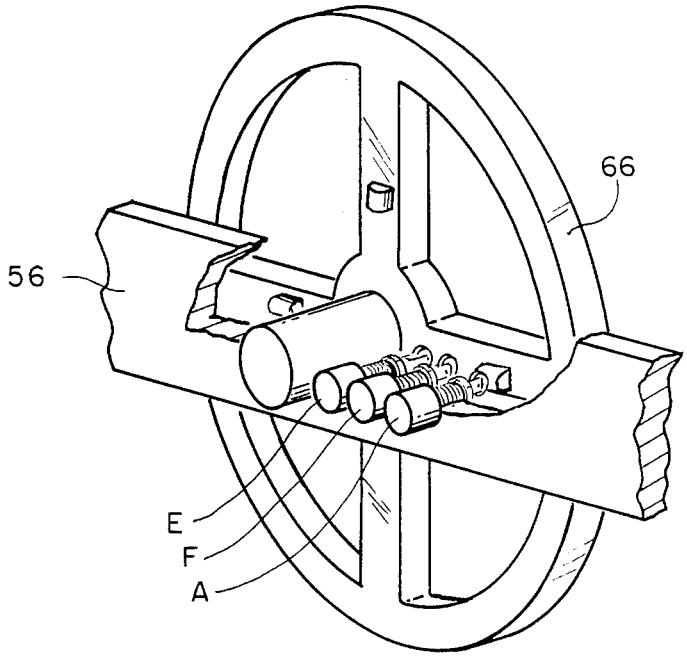
FIG. 12
FIG. 13
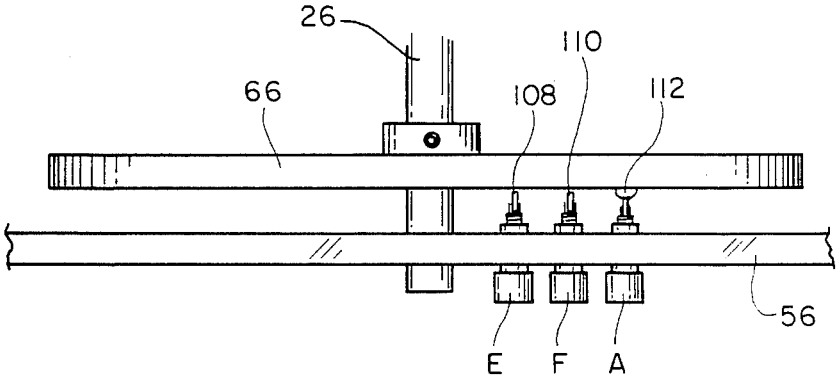
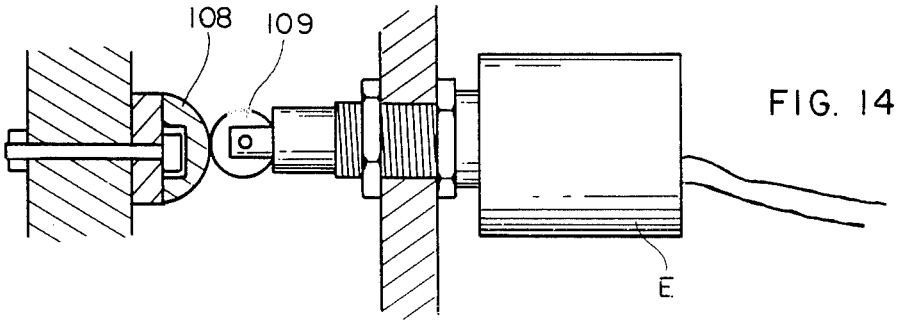
FIG. 14

CONTROLLER SEQUENCE

ROTARY STORAGE MAGAZINE

BACKGROUND OF THE INVENTION

In the past, a number of patents have been granted upon weapon loading systems and weapon storage systems. Some of these have been rotary devices, and some were adapted to be used in vehicles, but in each instance, loading was a slow and tedious process, and subsequent redelivery of missiles for the purpose of firing was likewise time consuming.

Unfortunately, such prior art storage systems consumed an unnecessary amount of space, and the delivery of missiles therefrom could not be accomplished without considerable use of power equipment. Furthermore, these prior art devices represented distinct personnel hazards, and were generally quite unsatisfactory for the intended purpose.

It was to accomplish an improvement upon rotary storage magazines that the present invention was evolved.

SUMMARY OF THE INVENTION

In accordance with this invention, we have provided a rotary storage magazine utilized below the level of the deck of a vehicle, such that munitions may be stored and thereafter quickly delivered therefrom, to the deck level of the vehicle on an as-needed basis. Our storage magazine utilizes fore and aft multi-armed rotary support devices disposed below deck level a spaced distance apart, which distance is less than the length of the munitions being stored. In the case of a motor vehicle, we preferably use one rotary storage magazine on each side of the vehicle.

The rotary support devices are utilized in pairs, with each device having a multiplicity of support arms, such that a like number of missiles in a generally parallel array may be nested between the arms of the related pair of devices. Typically, each of the rotary support devices has four support arms, and two devices driven together in rotation with aligned axes of rotation constitute a rotary support assembly. Means are provided for driving the rotary support devices or cruciform members in one rotative direction during the loading of the munitions into the storage magazine, and for driving these devices in the opposite rotative direction during the delivery of munitions to the deck level of the vehicle, for the purpose of reloading the firing apparatus.

Although for convenience we use the term "munitions", it is to be understood that we intend this term to include missiles alone, canister loaded missiles, or any other generally cylindrically shaped ordnance device, including torpedos, artillery rounds, and the like.

To prevent undesired dislodgement of the munitions from the rotary support devices during their rotation, highly reliable releasable restraint arms are utilized between each adjacent pair of support arms of the rotary support devices. Means are provided for automatically releasing these restraint arms when the munitions are to be delivered to the deck level of the vehicle.

Inasmuch as each munition may be relatively heavy, munition transporter means are utilized in the loading as well as the unloading of the rotary support assembly, and in the preferred embodiment, the munition transporter takes the form of an elevator means that is disposed between the rotary support devices. The elevator means is utilized during the loading of the multi-armed support assembly, and during the unloading thereof, the elevator means serves to raise each successive munition through a relatively small opening in the deck, to the deck level of the vehicle. Elevator movement may be used to effect an automatic release of the restraint arms, and quite advantageously, when the elevator is in its raised position, it provides a closure member that serves temporarily to prevent the opening in the deck from being a personnel hazard.

Another embodiment of our invention involves the vehicle having an unbroken deck, with loading and unloading of the munitions taking place through a side opening. In this embodiment, the munition transporter utilizes a lateral conveyor.

Although we use the word "vehicle" extensively herein, and depict our invention in connection with an infantry fighting vehicle equipped with tracks, it is to be understood that this invention could be used just as effectively on certain boats or ships, or even on a shore installation, including a compact version dropped by parachute in a military zone.

It is therefore a primary object of this invention to provide a compact system for the storage of munitions in a below-deck rotary storage bay of a vehicle or other structure, particularly when deck space is limited, such that the munitions can be readily and rapidly supplied to the deck level as needed.

It is another object of our invention to package four or so munitions in a below-deck storage space of minimal size, from which the munitions can be delivered semi-automatically or even automatically, and in a rapid manner to the deck of the vehicle.

It is yet another object of our invention to provide two or more multi-armed rotary support devices, between whose arms a plurality of munitions may be stored, this being in combination with munition transporter means functioning to accomplish a rapid delivery of such munitions to the deck level of the vehicle on an as-needed basis.

It is still another object of our invention to provide one or more rotary support devices supporting a generally parallel array of munitions, in combination with munition transporter means serving to lift each munition of the array through an opening to the deck level of the vehicle, and highly effective restraint arms, which preferably release each munition at the appropriate time as a function of elevator movement.

It is yet still another object of our invention to store munitions below deck on each side of a vehicle, from which storage the munitions may be rapidly delivered through a deck opening of minimal size in a preferred embodiment of our invention.

It is yet another object of our invention to provide a preferred embodiment utilizing an elevator in conjunction with rotary munition storage members, in which a compact component of the elevator, when in a raised position, serves as a temporary deck, so as to fill the hatch opening on the deck of a vehicle or the like, thereby eliminating a distinct safety hazard.

These and other objects, features and advantages will be more apparent as the description proceeds.

BRIEF DESCRIPTION OF DRAWINGS

FIG. 12 is a perspective view of the wheel used for driving the rotary storage assembly in rotation, with a plurality of plunger type limit switches mounted on the support member adjacent such wheel, to interact with cam members mounted on the wheel;

FIG. 13 is a top view of the wheel and switch arrangement of FIG. 12, revealing the manner in which cam members in the form of protuberances on the spokes of the wheel can interact with the plungers of the switches;

FIG. 14 is a view to a larger scale of a typical plunger type switch used in the arrangement of FIG. 12, revealing in detail how a protuberance can interact with the small wheel used on the outer end of the plunger member;

DETAILED DESCRIPTION OF THE PREFERRED EMBODIMENT

Figure 1:
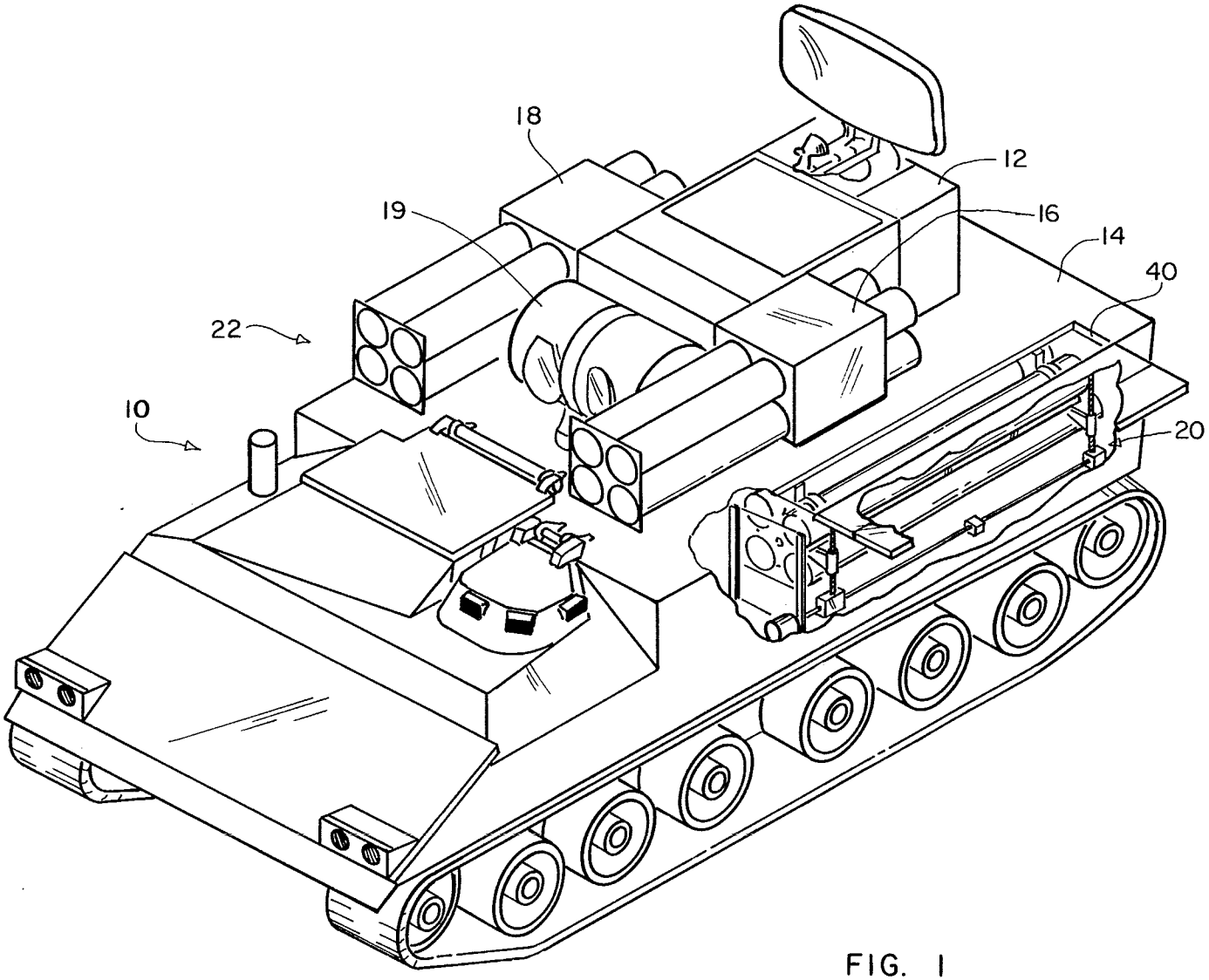
FIG. 1 is a perspective view of a typical vehicle utilizing one or more of our novel rotary storage magazines, in this instance being a tracked infantry fighting vehicle.

Turning to FIG. 1, we have there shown a tracked vehicle 10 in the nature of an infantry fighting vehicle, that is equipped to carry eight missiles, or eight canisters containing missiles. Four of these missiles or missile canisters are contained in a launcher yoke located on each side of a turret 12 rotatably mounted on the longitudinal centerline and above the deck 14 of the vehicle. In the typical instance, one missile is contained in each missile canister, but a larger number could be utilized if desired.

The missile canisters, hereinafter referred to as munitions, are to be normally inserted into launcher yokes 16 and 18 at a time when the turret has been rotated to point rearwardly. The launcher yokes are interconnected, such that they at all times elevate in like amounts, as well as moving together in azimuth as the turret 12 is swung around. If missile canisters are used, it is to be noted that each missile remains in its respective canister, and after being loaded into the launch yoke, it is intended that the missile be fired through the frangible cover at the end of the canister.

Between the launcher yokes 16 and 18 is a rotatable member 19 sometimes referred to as an "ashcan" that contains important portions of the guidance system used to guide the missiles or other weapons to the selected target, such as FLIR & TV components. However, neither the turret members nor the guidance system per se form any part of our invention.

Immediately to the right and below the launcher yoke 16 as viewed in FIG. 1 is a rotary storage magazine 20 that, in accordance with this invention, is responsible for storing munitions below deck, and for delivering them in a semi-automatic manner as needed for a manual reloading of one of the launcher yokes. Although not shown in FIG. 1, we utilize another rotary storage magazine 22 on the far side of the vehicle shown in FIG. 1, which is utilized in connection with the reloading of the other launcher yoke.

As may be noted in FIG. 1, but shown in more detail in FIG. 2, a typical multi-armed rotary support assembly in accordance with this invention utilizes a multi-armed rotary support device at each end, so that a plurality of munitions may be stored below deck, and retrieved when needed for the reloading of the launcher yokes. Similar rotary support assemblies are used in the two storage magazines, principally differing in rotating in opposite directions during the munition loading (and unloading) procedures. A typical number of munitions stored in each storage magazine is four, and therefore we may refer to the rotary storage devices as cruciform members. However, we can design the arrangement to accommodate a different number of munitions if desired.

The multi-armed rotary support assembly 23 involves a forward rotary support device 24, and a rear rotary support device 25, with it being understood that these preferably share a common axle 26, and thus rotate sychronously. Support is readily obtained by extending the axle 26 entirely through each rotary support device, in the manner shown at 26*a* in FIG. 2. The drive for the rotary support assembly can be at either end, but we prefer to utilize a reversible motor 60, placed near the rear end of the assembly, as will be discussed in connection with FIGS. 3 and 5.

Figure 2:
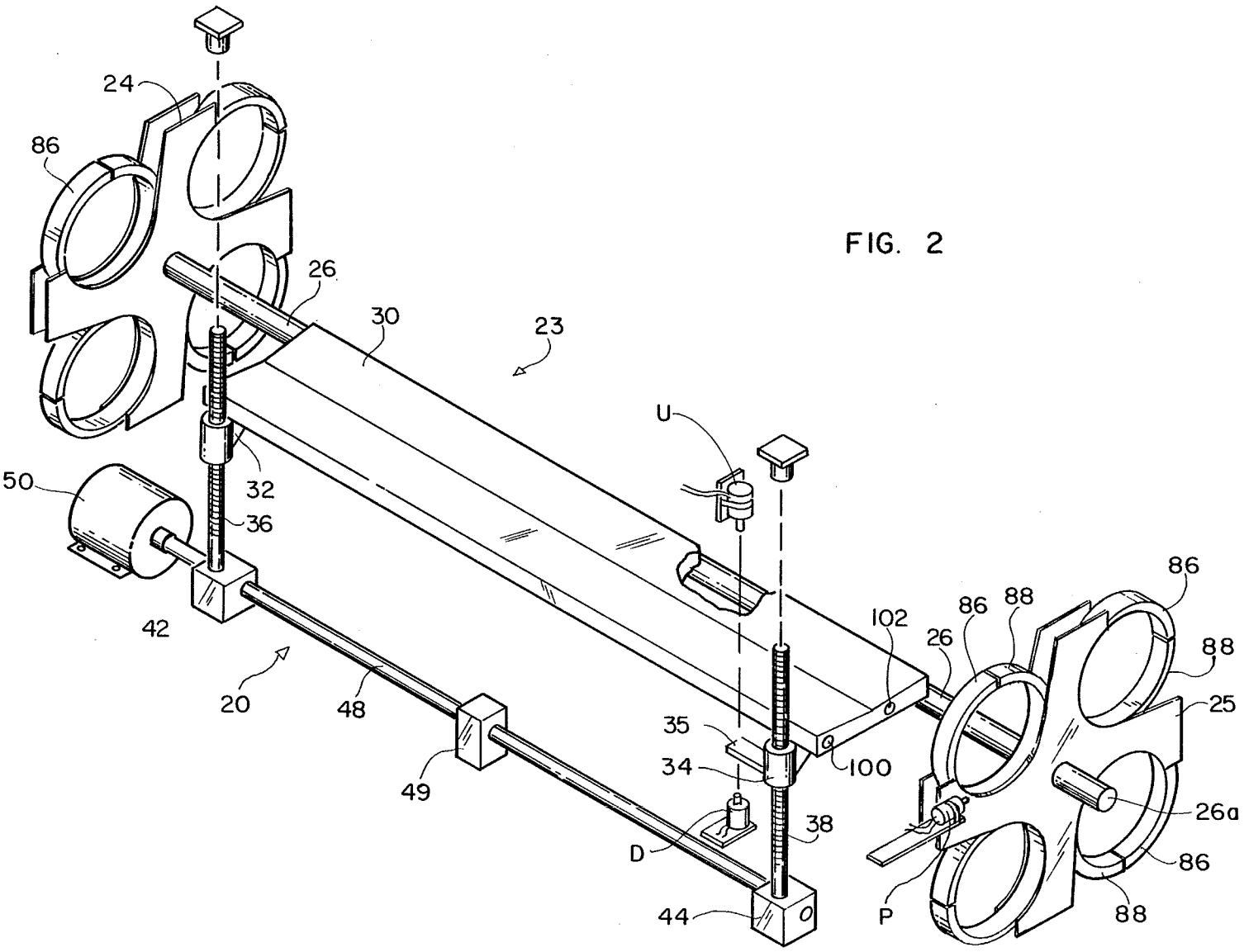
FIG. 2 is a perspective view of a typical cruciform assembly for supporting four munitions, illustrating that a pair of individual multi-armed rotary storage devices are mounted in aligned relation near the ends of a common shaft, and in this preferred embodiment revealing the vertically movable elevator operatively mounted between the rotary storage devices, and functional with respect to a deck hatch.
Figure 4:
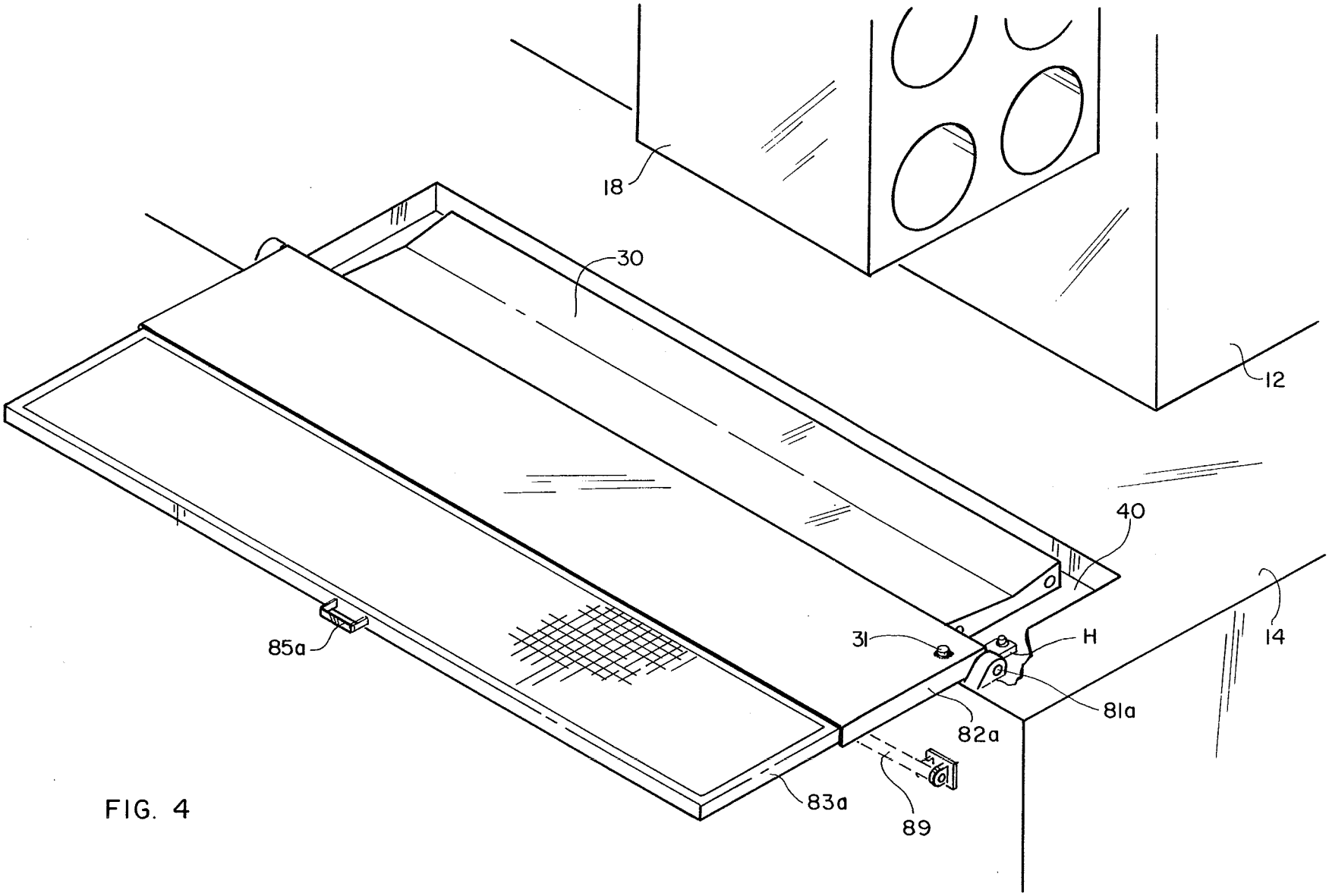
FIG. 4 is a perspective view revealing the relationship of the elevator to the hatch opening in the deck of the vehicle, and also revealing a different embodiment of a protective hatch closure door, this door including a work platform contained inside the door.

FIG. 2 represents a showing in accordance with a primary embodiment of our invention wherein loading as well as unloading of the rotary storage magazine is accomplished through a hatch opening in the deck of the vehicle. In this embodiment, we utilize a munition transporter in the form of an elevator 30, by the use of which we are able to readily accomplish the loading of the storage magazine, and subsequently to deliver the munitions rapidly and in a semi-automatic manner through the relatively small deck opening 40 to an above-deck location, for immediate utilization; see FIG. 4. The elevator member 30, best illustrated in FIGS. 2 and 4, is sufficiently short in its lengthwise dimension as to avoid undesired contact with the multi-armed rotary support devices 24 and 25. The elevator 30 operates outboard of the axle 26 extending between the rotary support devices 24 and 25.

In the somewhat simplified preferred embodiment illustrated in FIG. 2, the elevator member 30 is shown supported by forward arm 32 and rearward arm 34, and these arms are operatively associated with threaded ball screw actuator rods 36 and 38, which are essentially vertically disposed. These rods are operatively associated with gearboxes 42 and 44, respectively. Passing through these gearboxes is shaft 48, which is driven in rotation in the selected direction by means of motor 50, preferably a reversible DC motor. Distortion of the lengthy shaft 48 during use is prevented by the use of pillow block 49, in which the shaft is rotatable.

We are not to be limited to this particular arrangement, for in some instances, it may be desirable to utilize one or more smooth guide rods serving to assure proper alignment of the elevator at all times. In some instances when using guide means, only a single ball screw actuator, or hydraulic actuator, need be used.

Portions of the rotary storage devices 24 and 25 are hollow, each made up of fore and aft plates separated sufficiently for as to contain as many pairs of restraint arms as there are support arms on these two members. These restraint arms are utilized to prevent missile displacement during rotation of the rotary storage or cruciform assembly 23, and as seen in FIG. 2, but in greater detail in FIG. 6, each pair of restraint arms involves an arm 86 used in conjunction with an arm 88. These pairs of restraint arms are caused to operate by the use of cams 100 and 102 used on the ends of the elevator 30, and their function and interaction with restraint arm components will be discussed at length hereinafter in connection with FIGS. 7, 9, 9*a* and 9*b*.

Also visible in FIG. 2 are several devices in the nature of limit switches, which are utilized in the primary embodiment of our invention to assure proper operating interrelationships between the elevator and the respective rotary storage assembly. An activation tab 35 is mounted on rearward elevator support arm 34, and is movable therewith. Mounted in alignment with the tab 35 is an upper elevator limit switch U, and a lower elevator limit switch D. As a result of this arrangement, the activation tab moves with the elevator upwardly and downwardly, and when the actuator is moving up, the tab is eventually brought into contact with the plunger of the switch U, causing it to be depressed and to bring about the elevator stopping in the appropriate relationship to the deck 14. Similarly, when the elevator is moving down, the tab 35 is eventually brought into contact with the plunger of the switch D, causing it to be depressed and to bring about the elevator stopping in the appropriate relationship to the axle 26 of the cruciform assembly.

The presence switch P, supported by a suitable structural member, is disposed generally adjacent an end portion of the munition, and its plunger is caused to be depressed at such time as a munition is being supported by the support arms of the rotary storage assembly at the location directly below the hatch opening 40.

Figure 3:
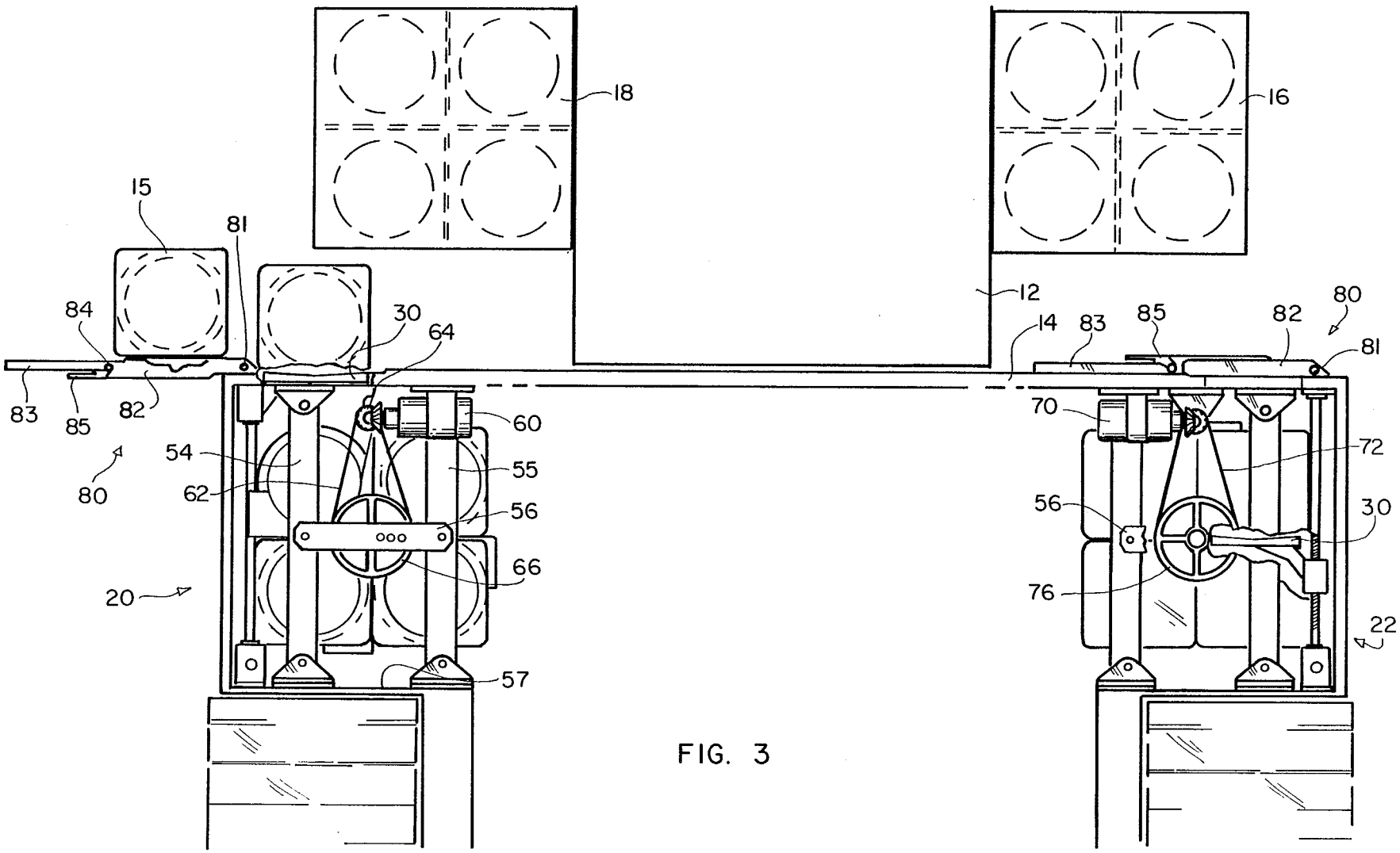
FIG. 3 is a forward-looking cross-sectional view taken through the vehicle, showing a rotary storage magazine adjacent each side of the vehicle in accordance with the preferred embodiment, and the relationship of certain essential components thereof, including a first embodiment of hatch closure doors.

Turning to FIG. 3, it will there be seen that we have provided a simplified cross-sectional view through a typical vehicle, revealing our novel rotary storage magazines in cross-section, with this view looking forwardly, and revealing that our rotary storge magazines 20 and 22 are below the deck 14 of the vehicle, and slightly outboard of the launcher yokes 18 and 16, respectively. It is to be noted that the launcher yokes in this instance have been moved into the rearwardly aimed direction, which is the proper direction for the loading of munitions into the yokes. The munition transporters of this embodiment, the elevators 30, are deliberately shown in different positions.

As shown on the left side in FIG. 3, it is desirable to provide a side work platform 80, that is hingedly mounted on the deck of the vehicle above and to the left of the rotary storage magazine 20. The work platform is deployable outwardly from a folded position when the yoke reloading function is to be pursued, and in this particular embodiment, the work platform is shown supporting a munition 15. By virtue of this arrangement, a person concerned with the transfer of munitions from the storage magazine 20 to the launcher yoke has a convenient place in which to stand.

The foldable work platform embodiment of FIG. 3 involves armored hatch door 82 being hinged along one of its long edges to the deck 14 by means of hinge 81. A door hinge 81 is illustrated on the left as well as on the right side of the vehicle of FIG. 3, and it is to be understood that when not in use, the doors or hatch covers 82 are in place over the respective hatch openings 40, as illustrated on the right hand side of FIG. 3. If weight becomes an important factor, we may resort to the use of a kevlar composite.

The grating portion 83 of the work platform is supported from the hatch cover 82 by means of hinge member 84 located along the opposite long edge from hinge 81. Adjacent the hinge 84 is a handle 85. Therefore, at such time as munitions are to be delivered from below by the respective elevator, the crew members grasp the handle 85 at each end of the door, lifting the door 82 and grating 83. Because these members are hingedly connected in the manner of bifold doors, they can readily be folded sufficiently as to easily clear the adjacent edge of the yoke.

Support of the work platform 80 may be augmented by the use of collapsable struts 89 in a plurality of locations, as generally indicated by the use of dashed lines in FIG. 4, but in latter figure, a somewhat different type of hatch closure and work platform arrangement is utilized, as will be explained hereinafter.

In FIG. 3 it will be noted that support legs 54 and 55 are provided on the left side of the vehicle, these legs being supported at least partially from the lower structural member 57 of the vehicle at a location overhanging the treads of the vehicle. Extending between the approximate mid-portions of legs 54 and 55 is a cross member 56 forming a support for the axle 26 of the rotary storage (cruciform) assembly 23 which, as previously discussed, utilizes shaft extensions **26*a* that ride in suitable bearings mounted in member 56. The member 56 can also serve as the mounting for a plurality of limit switches, as will be explained at length hereinafter in conjunction with FIGS. 10 and 11**.

Also shown on this side of FIG. 3 is the motor 60, preferably a reversible DC motor, that is supported above and somewhat to the rear of the cruciform assembly associated with rotary storage magazine 20. A toothed belt 62 extends around a toothed spocket 64 driven in an offset manner from the motor 60, with this toothed belt also passing around comparatively large toothed wheel 66, that is firmly mounted upon the previously mentioned extending portion **26*a* of the shaft 26. Because of this firm mounting on the shaft, the wheel 66 always bears a definite and preestablished relationship to the rotary storage assembly 23. As is obvious, upon the motor 60 being driven in one direction, the rotary storage assembly is caused to rotate clockwise as viewed in FIG. 3**, and to rotate counterclockwise when the motor is driven in the opposite direction. In each instance, the rotary storage assemblies are caused to rotate in the inboard direction when being loaded with munitions, and to rotate in the outboard direction when the munitions are to be re-delivered to the deck.

We are not to be limited to the use of a toothed belt drive, for a chain drive arrangement may in some instances be preferred.

Because the rotary storage means 22 on the right hand side of FIG. 3 is substantially identical to storage means 20, it is not believed necessary to describe the rotary storage means 22, although it is to be noted that a motor 70 having direction reversal characteristics is provided to drive a toothed belt 72 that in turn drives a large toothed wheel 76 that is firmly mounted on the end of the shaft associated with the rotary storage device of the rotary storage magazine 22 on the right side of FIG. 3. The use of the toothed wheels and toothed belt, or a chain drive arrangement can quite obviously be used in order to prevent slippage.

It is to be noted that on the left side of FIG. 3 we reveal the elevator 30 in the position in which it delivers munitions to deck level. In such position the elevator forms an effective closure for the hatch opening 40 with which it is operationally associated; note also FIG. 4. In contrast with the positioning of the elevator illustrated on the left side of FIG. 3, the elevator associated with rotary storage means 22 on the right side of the vehicle is shown in a position essentially even with and outboard of the axle 26, thus to be able to receive the next munition to be raised to deck level. Quite obviously the rotary storage assembly and elevator on the left side of the vehicle can be operated entirely independently of the rotary storage assembly and elevator on the right side, and vice versa.

With regard to FIG. 4, we here reveal an embodiment in which protective hatch door **82*a* is hinged to the deck by means of hinge 81*a*, with the door 82*a* having substantial integrity but nevertheless having a hollow interior so as to be able to accommodate therein, a grating member 83*a*. Therefore, at such time as a yoke reloading operation is to be accomplished, the use first moves the door 82*a* to the open position, and then grasps handle 85*a* in order to slide out the grating 83*a*** that serves as part of the work platform. Means (not shown) are used to prevent the grating from sliding out too far.

Also revealed in FIG. 4 is slightly recessed hatch switch H, concerned with preventing the elevator lifting a munition upwardly from below while the protective hatch cover **82*a* is still closed. A protuberance 31 on the underside of the protective door 82*a*** is so placed as to properly interact on occasion with the upstanding plunger member of the recessed switch H. These details will be discussed in some detail hereinafter.

Figures 5, 5A:
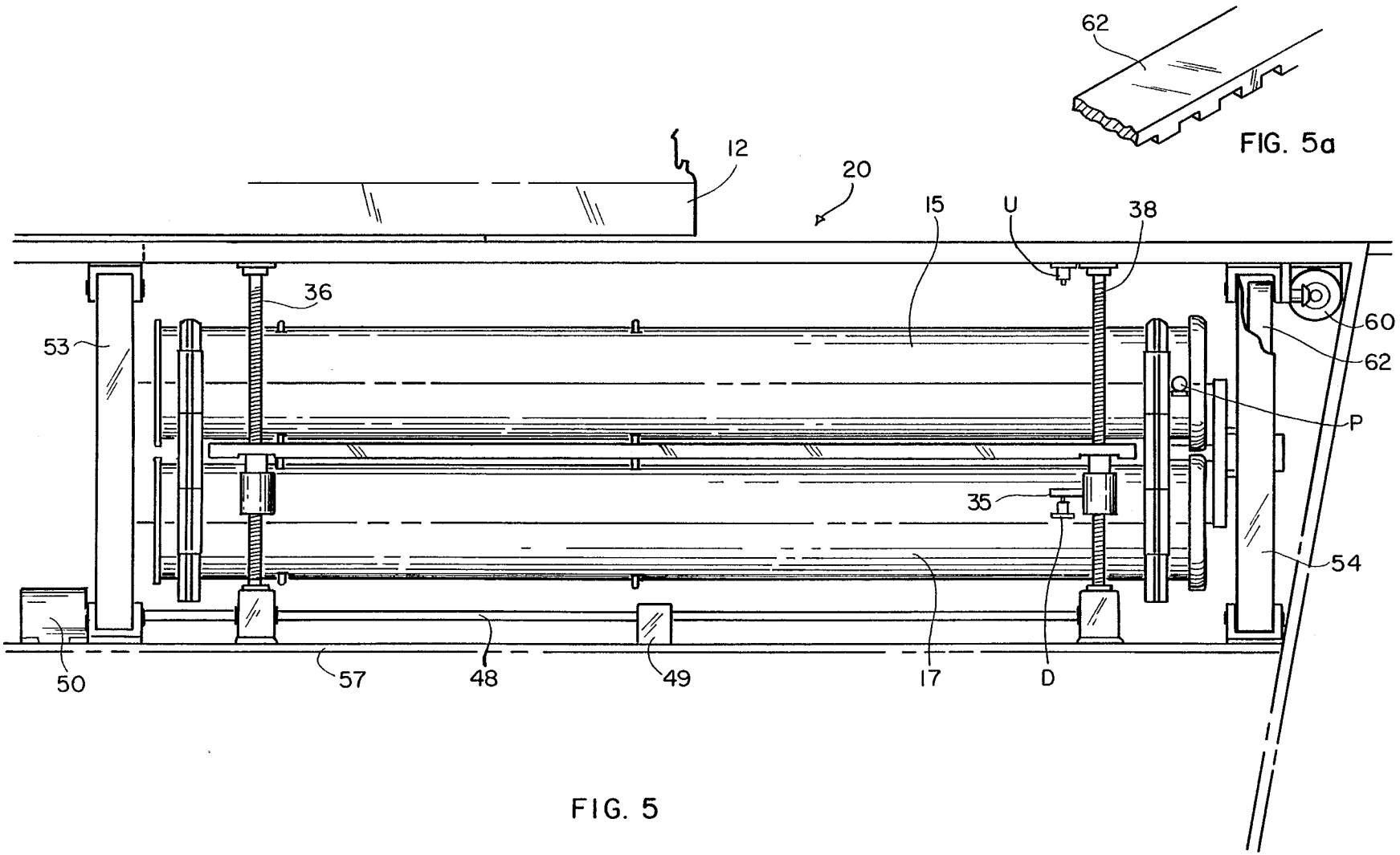
FIG. 5 is a longitudinal cross-sectional view revealing certain of the elevator, support arm and switch details as viewed from the left side of the vehicle, and showing the motor utilized for driving the rotary storage assembly in rotation, as well as the motor for powering the elevator.

In FIG. 5, we reveal a longitudinal showing of the rotary storage means 20, as viewed looking inboard from the left side of the vehicle. Clearly to be seen are munitions 15 and 17; the elevator motor 50; the rotary shaft 48 for providing power to the screwjacks associated with the elevator; and the lower structural member 57.

FIG. 5 also shows the motor 60 utilized for driving the rotary storage (cruciform) assembly in rotation by means of toothed belt 62. FIG. **5*a* shows additional detail of belt 62**. By way of example, a chain drive arrangement could instead be utilized.

Figure 6:
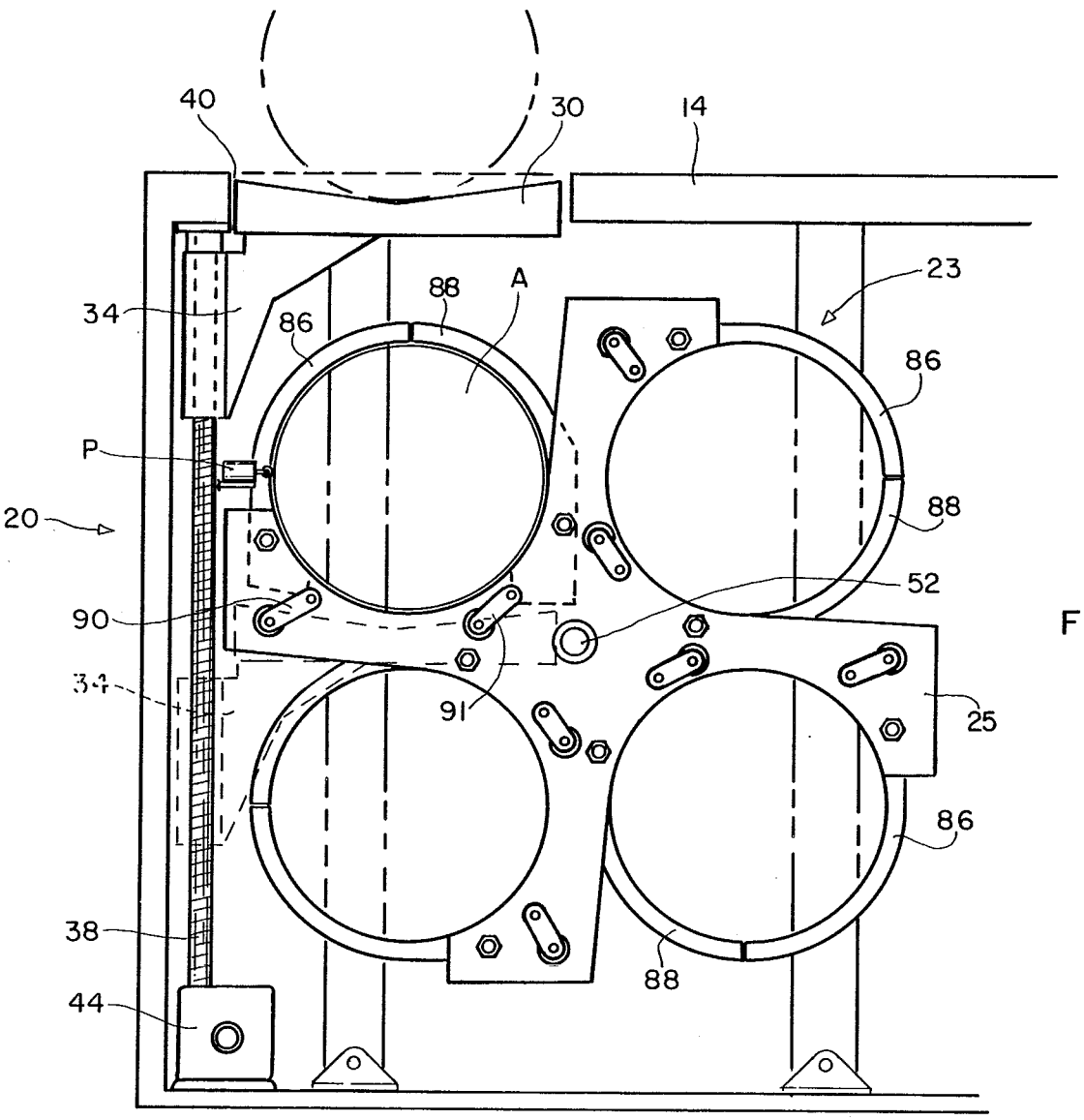
FIG. 6 is a cross-sectional aft end view to a somewhat larger scale, revealing the support arms of the rotary storage device, the manner in which the restraint arms of the rotary storage device secure the munitions against undesired displacement, and also how the elevator is able to raise a munition to the deck level.

FIG. 6 is a forward-looking view showing the rear rotary storage device 25 of the rotary storage or cruciform assembly in greater detail, which is supported for rotation about axis 52 by suitable bearings (not shown), which, as previously explained, are in turn supported by the member 56. As was shown in FIG. 3, the member 56 is supported by legs 54 and 55, and the lower ends of the legs are attached to and supported by the lower structural member 57. However, for reasons for clarity, members 54, 55 and 56 are not shown in FIG. 6.

Continuing with FIG. 6, nested between each pair of aligned support arms of the rotary storage assembly are munitions (such as missile canisters) located in designated positions, as described hereinafter. Also shown in this figure is rear elevator arms 34, that is driven in elevation by ball screw actuator shaft 38. As previously explained, shaft 38 is driven in rotation by gearbox 44 as a result of power supplied from the motor 50 to shaft 48, these components of course being depicted in FIG. 2. The elevator member 30 is in its lowered position as shown by dashed lines in FIG. 6, and it is in its raised positions as shown in full lines in this figure. Each munition is held between aligned support arms of the rotary storage devices 24 and 25 by means of respective automatically functioning restraint arms 86 and 88.

Generally indicated in FIG. 6 are latching mechanisms 90 and 91, associated with release of the restraint arms 86 and 88 when the elevator 30 is immediately below the munition in Position A. Such details will be described at greater length hereinafter.

As should now be realized, when the rotary storage assembly 20 as viewed in FIGS. 2 and 6 is caused to rotate in a counterclockwise direction, the munitions nested between the aligned support arms of the spaced pair of rotary storage members can be delivered one at a time to the elevator 30. Then, by successive upward trips, the elevator can individually unload each of the munitions of the rotary storage assembly through the hatch opening 40 to the surface of the deck 14 of the vehicle.

Because the munitions may be of substantial weight as well as being bulky to handle, the elevator member 30 is significant, this member being generally disposed between the arms of the rotary storage devices that are outermost at a given moment, or in other words, in the outboard position to the left of the axis of rotation as shown in FIG. 6. The support arm of the rotary storage devices are driven in synchronism, as previously mentioned, such that each successive munition is maintained in an essentially horizontal position during the loading procedure; during storage; as well as during the subsequent unloading (offloading) procedure, when munitions are redelivered to the deck 14 of the vehicle.

Thus, as a result of the simultaneous rotation of the front ball screw actuator 36 and the rear ball screw actuator 38, the munition-engaging elevator 30 is caused to engage the underside of the munition residing in Position A, and to lift that canister to the deck 14. Importantly, the bed of elevator 30 provides a distinct safety feature, in the form of a walkway to temporarily fill the hatch opening 40 at such time as a given munition has been placed on the deck of the vehicle, as previously mentioned.

It should now be clear that as viewed in FIG. 6, the rotary storage assembly 23 of rotary storage means 20 is driven in rotation in a clockwise direction during the loading of the munitions into the magazine, but in a counterclockwise direction as the munitions are to be removed by the elevator from the support arms of the rotary storage devices, and delivered through hatch opening 40 to the surface of the deck 14. On the opposite side of the vehicle, and as best seen in FIG. 3, the rotary storage devices of the rotary storage means 22 rotates counterclockwise during loading, and clockwise during the unloading procedure.

Figure 9:
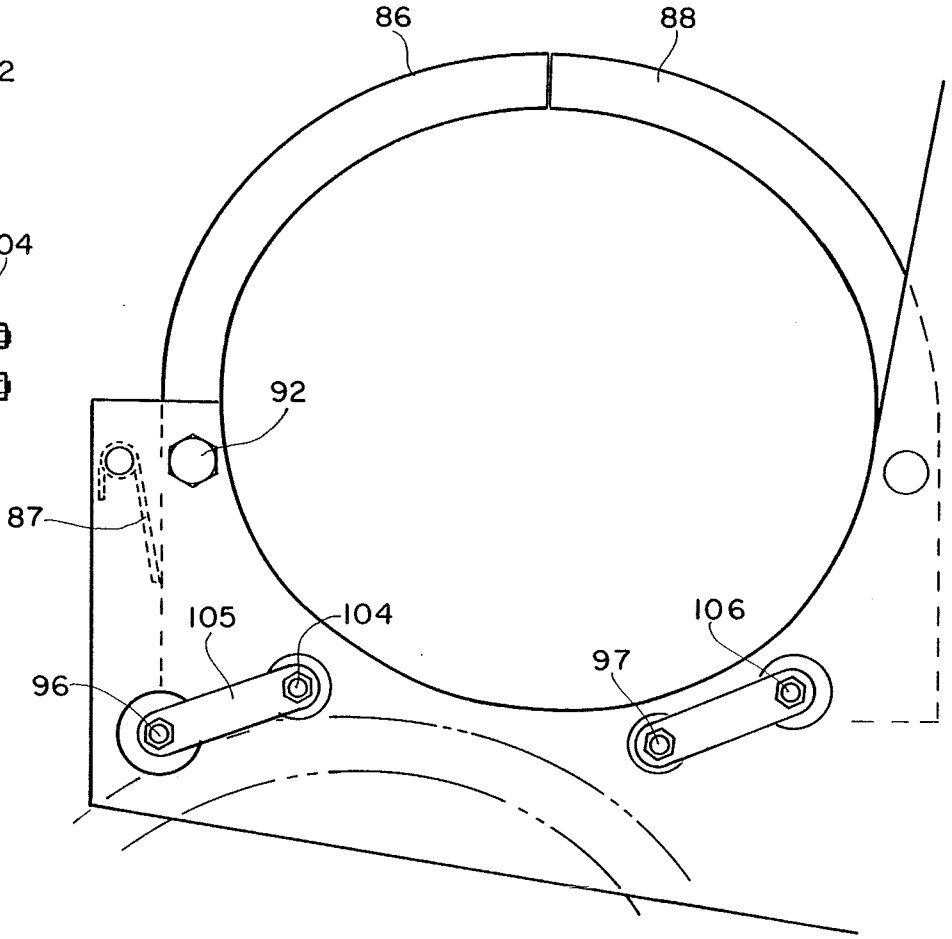
FIGS. 9 and 9*a* through 9*c* are views of certain important details associated with the automatic release of the restraint arms as a result of their relationship to cams mounted on the ends of the elevator.
Figure 9B:
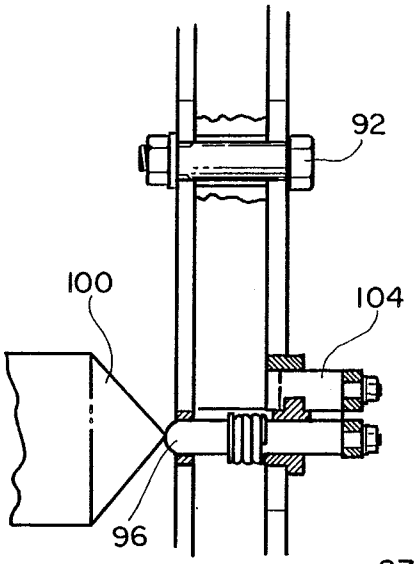

It is obvious that if no securing means were used, the munitions would tend to become dislodged from the rotary storage assembly due to the effect of gravity during rotation of the cruciform support arms, particularly when it is realized that in some instances, a given munition is located below rather than above its respective support arms. We prevent such dislodgement by the use of restraint or latching arms 86 and 88 associated with each munition support component of the rotary storage device, as generally shown in FIGS, 2, 6, 7 and 9. These restraint arms are spring biased to the open position, such as by a spring 87 as shown in FIG. 9, and are pivotally mounted upon pins 92. Each restraint arm is typically designed to encompass some 130 degrees of the munition. The restraint arms necessarily remain in the open position illustrated in FIG. 7 at the time a munition is being received, or at the time a munition has been raised to deck level and is being lifted by the elevator through hatch opening 40. However, at all other times, these arms are maintained in the latched position and hence are to be regardable as normally closed.

Figure 7:
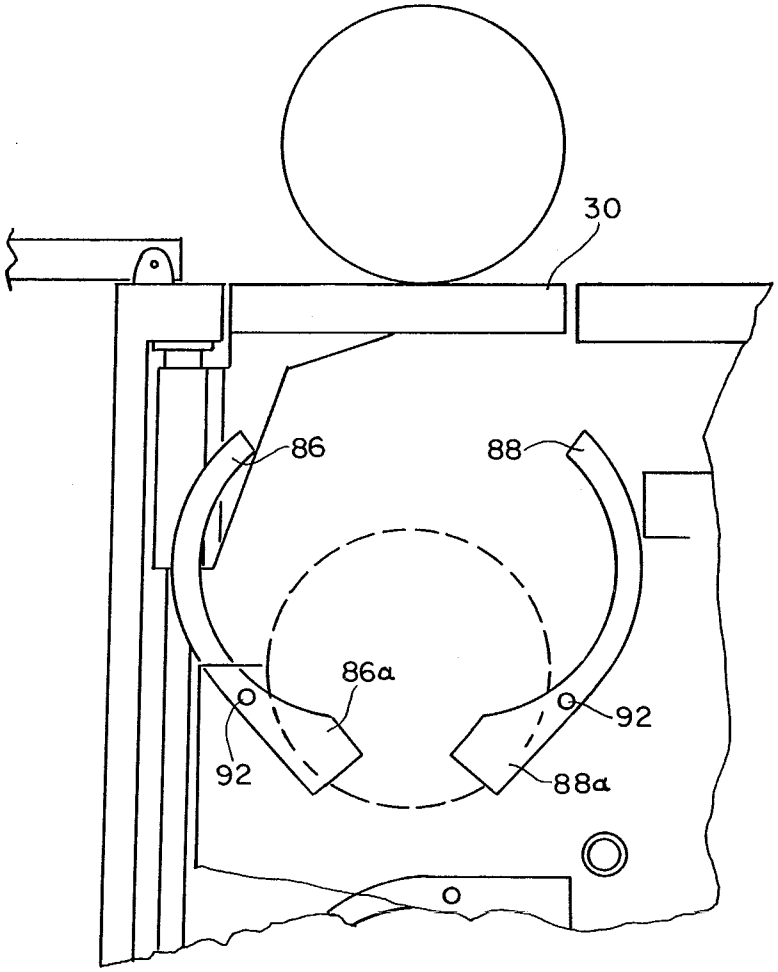
FIG. 7 is a forward-looking end view to an even larger scale, showing the manner in which the restraint arms move apart to release a munition immediately prior to lifting by the elevator.

It is important to note in FIG. 7 that the lower portions **86*a* and 88*a* of the restraint arms are on the other side of the pivot locations from the respective principal portions of members 86 and 88**, and protrude, under the bias of respective springs, into the space normally occupied by the munition when the munition has been lifted away.

As will be readily understood, when a new munition is being lowered by the elevator through the hatch opening into the respective support components or arms of the rotary storage devices, contact with the lower portions **86*a* and 88*a* causes the open restraint arms 86 and 88 to pivot about their respective pins 92**, to encircle the munition, and to firmly latch in the closed position in order to hold the munition against dislodgement with respect to the support components (arms) of the cruciform members.

Figure 8:
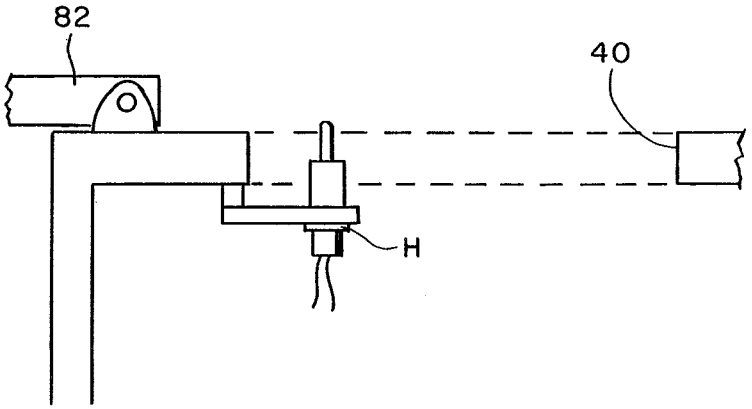
FIG. 8 is a view revealing the width of a typical hatch of the preferred embodiment, and the switch used in connection with the hatch closure member.

In FIG. 8 we show a portion of a typical protective hatch member, and a slightly recessed hatch switch H in the nature of an interlock used therewith. As should be obvious, unless the protective hatch 82 has been opened, the actuator of switch H will be pushed down, and this switch will electrically prevent proper operation of the elevator, thus preventing the elevator trying to lift a missile when the hatch 82 has been locked.

In FIG. 9 we show a pair of restraint arms 86 and 88 in the closed position, each being pivotably mounted on its own pin 92.

In FIGS. **9*a* and 9*c*, it will be seen that we have illustrated by the use of additional detail, how each pair of restraint arms is caused to release the respective munition when the munition is engaged by the principal elevator member 30. We utilize a slidable pin on each support arm, in association with each restraint arm, with one of such pins, pin 96, being clearly seen in FIG. 9*a*. This pin is normally biased to the left by means of spring 98, and is connected to latch member 104 by means of a short plate 105. When pin 96** is in the position shown in FIG. 9*a*, its closely associated latch member 104 serves to prevent release of the munition by the restraint arm 86.

Figure 9C:
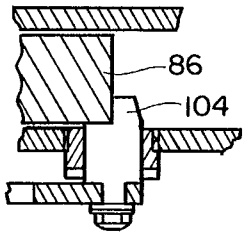
Figure 9A:
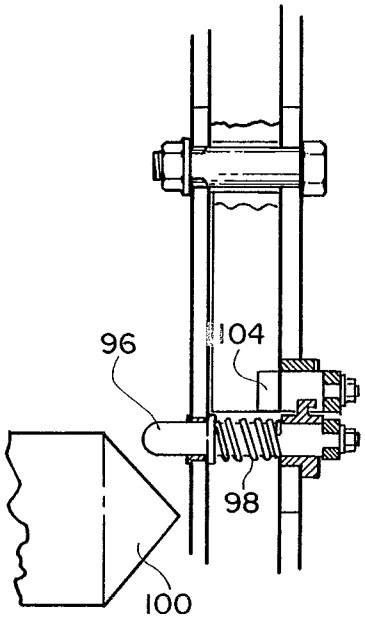

It is to be noted in FIG. 9*a* that a cam in the nature of a protuberance 100 on the edge of the end of the elevator 30 is arranged to move closely adjacent the rounded tip of pin 96. Therefore, upon the elevator rising to the position shown in FIG. 9*b* in which the high point of the cam 100 is alongside the pin, the cam causes pin 96 to move to the right against the bias of spring 98, and at the same time move its latch member 104 to the right in this instance. This releases the respective restraint arm, arm 86, so that the arm can pivot about pin 92 under the influence of its spring bias (87) to the open position, as was shown in FIG. 7.

A similar mechanism is associated with arm 88, with a pin at location 97 being moved by cam 102 (see FIG. 2) at the same time as pin 96 is moved by cam 100. As in the case of pin 96 and latch 104, the sliding of pin 97 causes a latch at location 106 to move to release arm 88.

A pair of protuberances on the other end of the elevator brings about a contemporaneous release of the restraint arms on the other end of the rotary storage assembly, also by interaction of protuberances with pin and latch arrangements of the type described above. As is obvious, this release procedure is repeated with respect to each munition delivered to the deck, with there being four pins in the nature of pin 96 to be released with respect to each munition.

It is important to note that each latch member is configured so as to permit ready relatching of the respective arm at such time as the arm has been pushed back to the closed position, such as by a munition coming into contact with the lower portions 86*a* and 88*a* of the arms, as explained in connection with FIG. 7, or by the outboard arm 86 coming into contact with an arm closure assembly mounted on the interior surface of the adjacent exterior wall of the vehicle. The arm closure assembly will be discussed shortly.

With latch 104 as an example, this component has an angled face, much as the angled face on a slidable door latch mechanism, so that upon that face being contacted by the respective arm 86 or 88 moving toward its closed position, the latch is caused to move against the force of spring 98 until the arm is able to pass by. At that time, the latch then moves to secure the arm in its closed position. Fragmentary FIG. 9*c* is intended to indicate the general configuration of latch member 104, with it to be understood that the curved or angled face of latter member is not directly shown in this figure.

Figure 10:
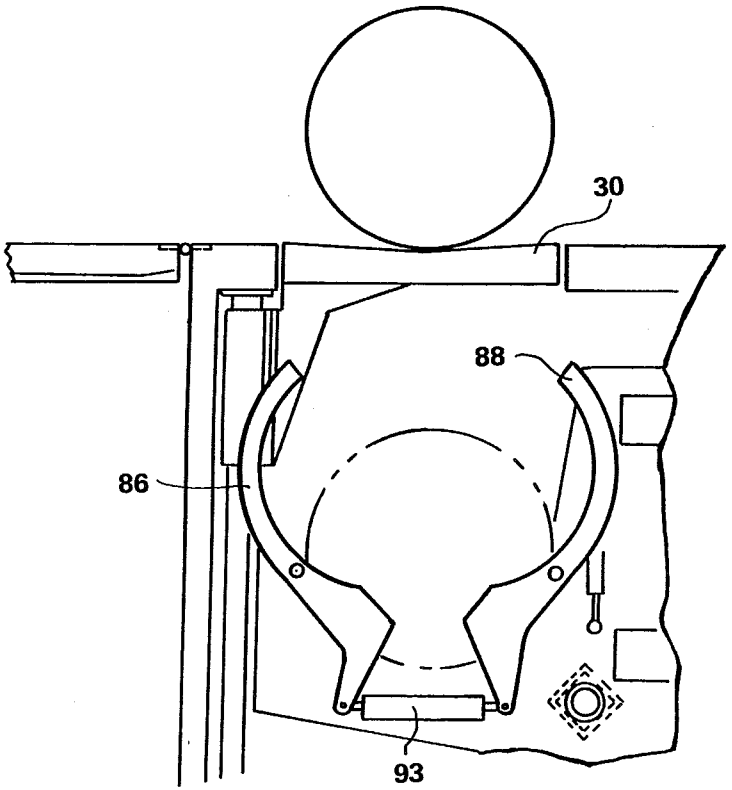
FIG. 10 is a forward-looking cross-sectional view of an embodiment of our invention generally similar to FIG. 7 in that it reveals the restraint arms on the left side of the vehicle, but with the provision of an actuator that can be utilized to bring the arms back to their closed positions.

In FIG. 10 we have shown an optional embodiment in which an actuator 93 is utilized below the pivot locations of the arms 86 and 88, so as to directly and mechanically effect closure of the arms at the behest of an operator. The actuator would be operated in an instance in which a munition had been removed and lifted to the deck, and it become desirable to rotate the cruciform assembly without the extended outboard arm striking some obstruction. The actuator 93 can be hydraulic, pneumatic, or even electrically operated.

Figure 11:
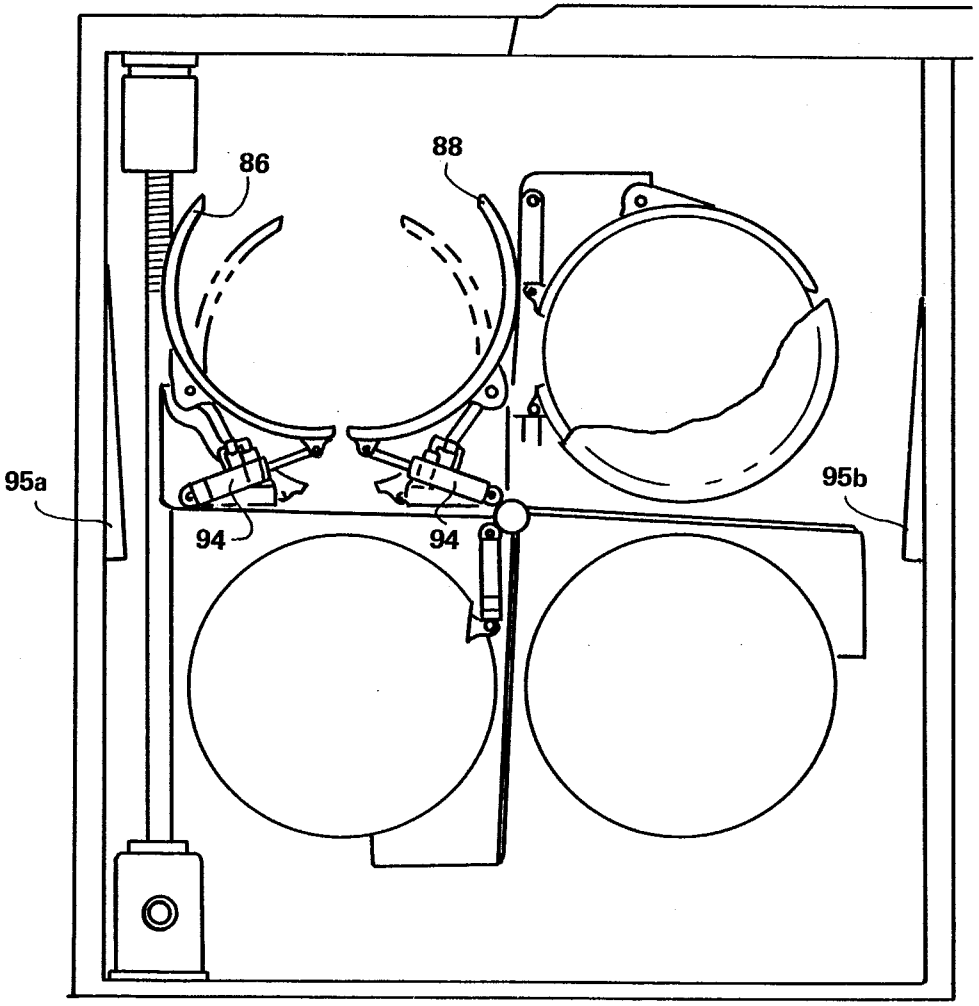
FIG. 11 is still another embodiment of an arrangement utilizing power means for closing the restraint arms.

In FIG. 11 we show how a separate actuator 94 can be utilized with each of the restraint arms, with these actuators being available to cause the return of the restraint arms to their inward, latched positions. However, we also show in this figure, the mounting of an arm closure assembly 95*a* on the interior surface of the exterior wall of the vehicle. The arm closure assembly has a tapered or wedge shaped configuration, and can either be of semihard rubber or plastic, or else a spring biased plate of metal with a rubber or plastic coating.

Inasmuch as the rotary storage means illustrated in FIG. 11 is on the left side of the vehicle, its restraint arms will be in their outwardly extended positions at such time as the munitions, that had been held in the arms of the rotary storage means, have been delivered to the deck of the vehicle as a consequence of counterclockwise rotation as viewed in FIG. 11, and of course, as a result of suitable interaction with the elevator 30.

As each outwardly extending arm 86 moves past the wedge-shaped arm closure assembly 95*a*, it is caused to move inwardly by interaction with the member 95*a*, to a position such that it will operate the respective latch member 104, and be held by the member 104 in its inwardly or latched position. The arms 88 may be permitted to remain in their outwardly extending positions during this rotation in the counterclockwise direction, for normally they are not in such relationships to other components as to be in collision therewith. However, we also provide a wedge-shaped arm closure assembly 95*b* in operative relationship to the restraint arms 88, so that closure thereof can be effected if the rotary support assembly 23 turns clockwise while the restraint arms are in the extended position. Quite clearly, there are arm closure assemblies at both ends of the munition storage bay, in operative relationship to the restraint arms at each end of the rotary support assembly.

It is to be realized that for any of the embodiments of our invention in which actuators are not provided for moving the restraint arms away from their extended positions, the use of wedge-shaped arm closure assemblies are of considerable importance, in that they form the primary means for outboard restraint arm reclosure.

The wedge-shaped arm closure assemblies may be considered to be redundant in instances in which actuators are attached to the restraint arms for reclosure purposes, but we nevertheless prefer to provide same. This is because if an arm reclosure actuator fails, the respective arm closure assembly would be effective in reclosing the restraint arm, for we use a suitable safety relief valve arrangement that is incorporated into that portion of the hydraulic system, so that the extended restraint arm can be forced by the arm closure assembly, back into the latched position.

It should now be seen that we have provided an exceedingly convenient and compact storage magazine, whereby a number of munitions can be carried aboard a vehicle or boat, and by virtue of such arrangement, munitions can be quickly moved to deck level of the vehicle, for immediate reloading of the launcher yokes. As previously mentioned, yokes 16 and 18 are typically turned rearwardly during the reloading procedure, and ordinarily the munitions are of a weight such that two men working together can readily insert munitions into the yokes after the empty canisters have been removed from the yokes.

It is obvious that controls must be provided for our rotary storage magazine, serving to assure, for example, that the large wheels 66 and 76 turn their respective rotary storage assemblies for a full 90° each time, and that the elevator will not move at an improper time, nor in an improper direction.

One approach we may take entails the use of a plurality of limit switches, of the type illustrated and discussed in connection with the elevator 30 in FIG. 2.

Turning now to FIG. 12, we may place suitable protuberances or cams at preascertained locations on the spokes of the large wheel 66 that is utilized to drive the rotary storage (cruciform) assembly 23 in rotation. Since the rotary storage assembly on the right side of the vehicle driven by wheel 76 is for all intents and purposes identical to the rotary storage assembly 23 except as to directions of installation and rotation, it is not believed necessary to describe anything further than the control system used with rotary storage assembly 23.

Continuing with FIG. 12, a series of plunger type limit switches are provided on the cross member 56, in positions that correspond to and properly interact with such protuberances or cams.

In accordance with one embodiment, we installed a plunger type position switch E on the member 56 at a location relatively close to the axis of the rotation of the wheel 66, and arranged a protuberance 108 on one spoke of the wheel 66 to interact with the plunger of limit switch E. As a result of that arrangement, the switch E will provide a signal to the control system when the wheel 66 has rotated the respective rotary storage assembly to the "empty" position. As explained hereinafter at greater length, the "empty" position of rotary storage assembly 23 corresponds to Position I in FIG. 15.

Similarly, we installed a position switch F on the member 56 at a location slightly further from the axis of rotation of the wheel 66, which switch is arranged to interact with a protuberance 110 on a different spoke of wheel 66, such that when the corresponding rotary storage (cruciform) assembly is in the "full" position, such will be properly indicated to the control system. The full position corresponds to Position IV of FIG. 15.

Figure 15:
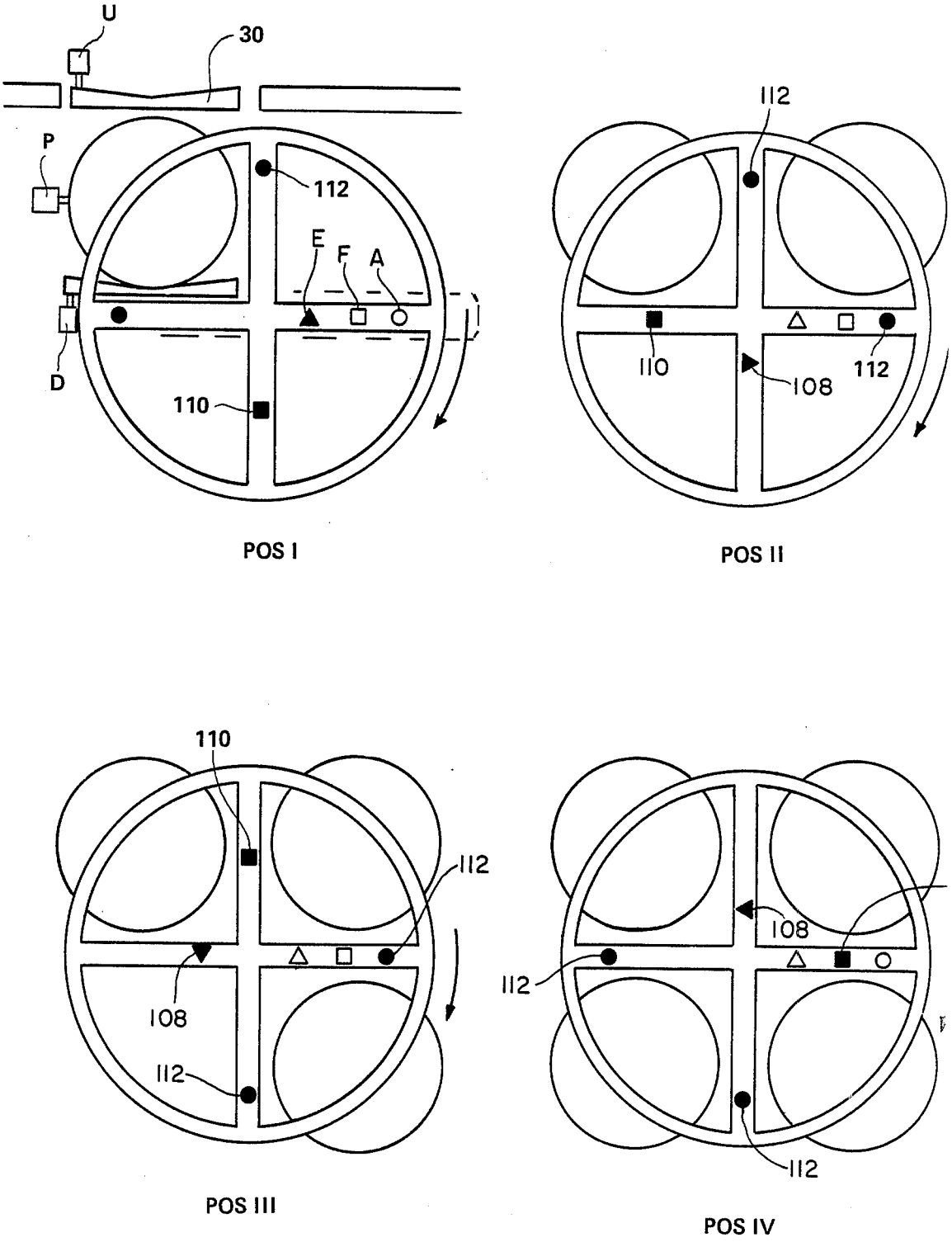
FIG. 15 presents four somewhat simplified and idealized views, generally indicating how four munitions can be individually loaded into the rotary storage assembly by appropriate interaction with the elevator.

It is obvious from FIG. 15 that the rotary storage member turns only 270° in rotating between Position I and Position IV. It is also obvious that a munition must not be in a position to block the descending elevator, and that the rotary storage member must turn exactly 90° each time it is moved, in order that it will always be in the position to properly interact with the elevator 30 during transfer of a munition. With regard to the latter, we provide an Alignment Switch A on the member 56, that is still further from the axis of rotation of the wheel 66. A protuberance or cam 112 is provided on the remaining two spokes of the wheel 66, so that proper alignment of the wheel 66, and more importantly the alignment of the rotary storage member, will be assured in all of its positions, Position I through Position IV, by the functioning of switches A, E or F. This is true inasmuch as we prefer to also use switches E and F in some instances to indicate proper rotational alignment.

FIG. 13 represents a top view of the wheel and position switch arrangement of FIG. 12, and it is to be understood that the limit or position switches could be disposed in somewhat different positions than this if desirable or necessary.

FIG. 14 represents a typical arrangement of switch and protuberance, in this instance protuberance 108 that interacts with switch E. The protuberance 108, like the others, is mounted on a bolt or bolts secured by suitable nuts to the appropriate spoke of the wheel 66, such that its position can be changed as necessary in order to properly interact with the small wheel 109 of the plunger of switch E. Likewise, the switch E is mounted in a somewhat elongate hole (not shown) in the member 56, so that its position away from the axis of rotation of the member 66 can be altered slightly whenever necessary for proper alignment.

Turning again to FIG. 15, it will there be seen that we have shown by somewhat simplified sketches, the four rotational positions of the cruciform member that are utilized during the procedure of loading munitions onto the rotary storage assembly. Also indicated in Position I of this Figure are the elevator 30, the elevator limit switc U, the elevator limit switch D, and the presence switch P. These latter three switches were previously shown in connection with FIG. 2, and it is to be understood that in reality, the elevator limit switches U and D are mounted with respect to the activation tab 35 as described in connection with FIG. 2, rather than with respect to the elevator. The depicting of the limit switches in the simplified showing of FIG. 15 is only for reader convenience.

It is to be noted that during the terminal phase of the elevator's upward movement, the tab 35 acts against the plunger of switch U, so as to bring about an opening of the circuit of the elevator motor 50. As a result, the elevator will go no higher than the proper position with respect to the deck 14 as will permit either the receipt of a munition, or the subsequent offloading thereof. Similarly, the switch D prevents the elevator 30 from descending below the location at which it can properly place a missile upon the adjacent support arms of the rotary storage assembly, or receive a missile to be lifted therefrom.

As was shown in FIG. 8, we utilize a slightly recessed hatch switch H, whose plunger moves to an upward position when the protective hatch cover 82 has been moved to the open position. Only when the protective hatch cover has been opened, does the switch H close the electrical circuit, permitting the loading or offloading procedure to be carried out.

In Position I in FIG. 15, we have shown by a triangle, square and circle, the locations of the switches E, F and A. The protuberances 108, 110 and 112, used respectively with switches E, F and A, are also of a like configuration as they appear on the spokes of the wheel 66. As a further refinement of this coding scheme that we are using for clarity of explanation, the protuberances in each instance are darkened, whereas the switches E, F and A are "hollow" except when the corresponding protuberance is at the location of its switch.

Therefore, in Position I, the triangle is darkened, for the protuberance 108 in this instance is in the location to operate the switch E, whereas the protuberance 110 is still 270° away from contacting switch F. Although alignment of the wheel when in Position I is still important, we minimize the number of protuberances 112 needed by utilizing other switches, such as the switch E in this instance, in order to provide an indication of proper alignment. Therefore, in Position I, the circle representing switch A is not filled in, for an alignment protuberance is not here needed.

In Position II, both the triangle representing switch E and the square representing switch F are understandably hollow, for the rotary storage assembly is neither empty nor full, but the circle has been darkened to show that a first protuberance 112 is in contact with switch A in order to provide an indication of alignment. In this figure, the protuberance 108 has been moved 90° away from its switch, switch E, and protuberance 110 is still 180° away from its switch F.

In Position III, the switches E and F are still hollow to connote no protuberance in connection therewith, whereas a second protuberance 112 has moved into contact with switch A, to indicate proper alignment.

The protuberance 110 will be noted to still be 90° away from switch F, and protuberance 108 at this point is 180° away from switch E.

In Position IV, the protuberance 110 has moved into alignment with its switch F, thus warranting square F being darkened, for the rotary storage assembly is now full. However, the alignment switch A is shown hollow inasmuch as proper alignment is obtained in this instance by the interaction of protuberance 110 with switch F. At this instant, protuberance 108 is 270° away from switch E.

Figure 16:
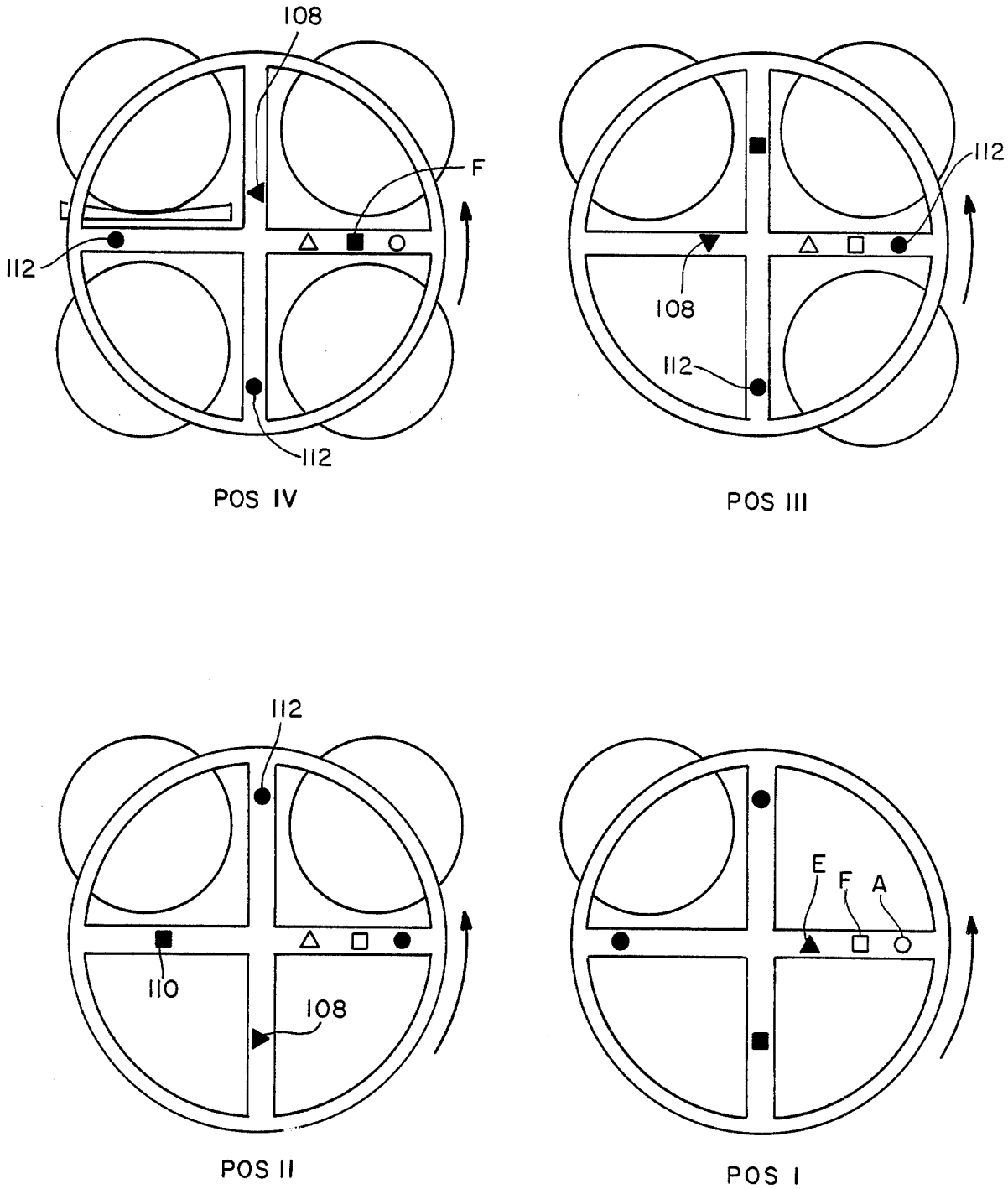
FIG. 16 presents four similarly simplified idealized views indicating how the four munitions can be offloaded from the rotary storage assembly by another type of interaction with the elevator.

Turning now to FIG. 16, it will be seen that we have indicated in a manner similar to FIG. 15, the conditions of the switches during the unloading procedure, which is the condition in which munitions are being delivered to the deck. In Position IV, four munitions are depicted as being supported by the rotary storage assembly, with the elevator being shown supporting the munition that is residing in Position A. In Position IV, only the switch F has been darkened, for that is the location at this time of protuberance 110, whereas the triangle and the circle are both hollow inasmuch as their protuberances are not in contact therewith.

In Position III, a first of the munitions has been delivered to the deck, and in this instance, only switch A has been darkened, because a first of its protuberances has moved into contact therewith.

In Position II, a second of the munitions has been delivered to the deck, and again, only switch A has been darkened, because the second protuberance 112 has moved into contact therewith.

Lastly, in Position I, only a single munition remains on the cruciform assembly, and here switch E has been darkened to show that its protuberance 108 is in contact therewith.

Some of the salient switch positions during the primary portion of the magazine loading procedure are as follows:

For First Munition (Position I)

1. Hatch switch H shows OPEN
2. Elevator limit switch U shows UP
3. Rotary storage alignment switch A is NOT actuated (switch E substitutes)
4. Position switch E shows POSITION I and proper rotational alignment
5. Position switch F NOT actuated
6. Presence switch P shows EMPTY (until missile received)

For Second Munition (Position II)

1. Hatch switch H shows OPEN
2. Elevator limit switch U shows UP
3. Rotary storage alignment switch A is ACTUATED
4. Position switch E NOT actuated
5. Position switch F NOT actuated
6. Presence switch P shows EMPTY (until missile received)

For Third Munition (Position III)

1. Hatch switch H shows OPEN
2. Elevator limit switch U shows UP
3. Rotary storage alignment switch A is actuated
4. Position switch E NOT actuated
5. Position switch F NOT actuated
6. Presence switch P shows EMPTY (until missile received)

For Fourth Munition (Position IV)

1. Hatch switch H shows OPEN
2. Elevator limit switch U shows UP
3. Rotary storage alignment switch A is NOT actuated (switch F substitutes).
4. Position switch E NOT actuated -continued 5. Position switch F shows Position IV and proper rotational alignment
6. Presence switch P shows EMPTY (until missile rec'd)

Other switch relationships and sequences not considered above may relate to positioning the equipment for the loading procedure, and the like.

Turning again to FIG. 16, it will be seen in this figure that a munition resides in each of the four locations symbolically indicated in this figure, with Position IV appearing at the top of this figure. By successive counterclockwise rotations of the rotary storage assembly to these four indicated positions, the elevator can individually raise these munitions to the deck during what we call the offloading procedure, which is the time these munitions can be loaded into the launch yokes 16 and 18 as needed.

A typical magazine offloading procedure is as follows:

For Delivery of First Missile (Position IV)

1. Hatch switch H shows OPEN
2. Elevator limit switch D shows DOWN
3. Rotary storage alignment switch A is NOT actuated (Switch F substitutes)
4. Position switch E NOT actuated
5. Position switch F shows Position IV and proper rotational alignment
6. Presence switch P is ACTUATED (until missile lifted)

For Delivery of Second Missile (Position III)

1. Hatch switch H shows OPEN
2. Elevator limit switch D shows DOWN
3. Rotary storage alignment switch A is ACTUATED
4. Position switch E NOT actuated
5. Position switch F NOT actuated
6. Presence switch P ACTUATED (until missile lifted)

For Delivery of Third Missile (Position II)

1. Hatch switch H shows OPEN
2. Elevator limit switch D shows DOWN
3. Rotary storage alignment switch A is ACTUATED
4. Position switch E NOT actuated
5. Position switch F NOT actuated
6. Presence switch P is actuated (until missile lifted)

For Delivery of Last Missile (Position I)

1. Hatch switch H shows OPEN
2. Elevator limit switch D shows DOWN
3. Rotary storage alignment switch A is NOT actuated
4. Position switch E shows Position I and proper rotational alignment
5. Position switch F is NOT actuated
6. Presence switch P is ACTUATED (until missile lifted)

Figure 19:
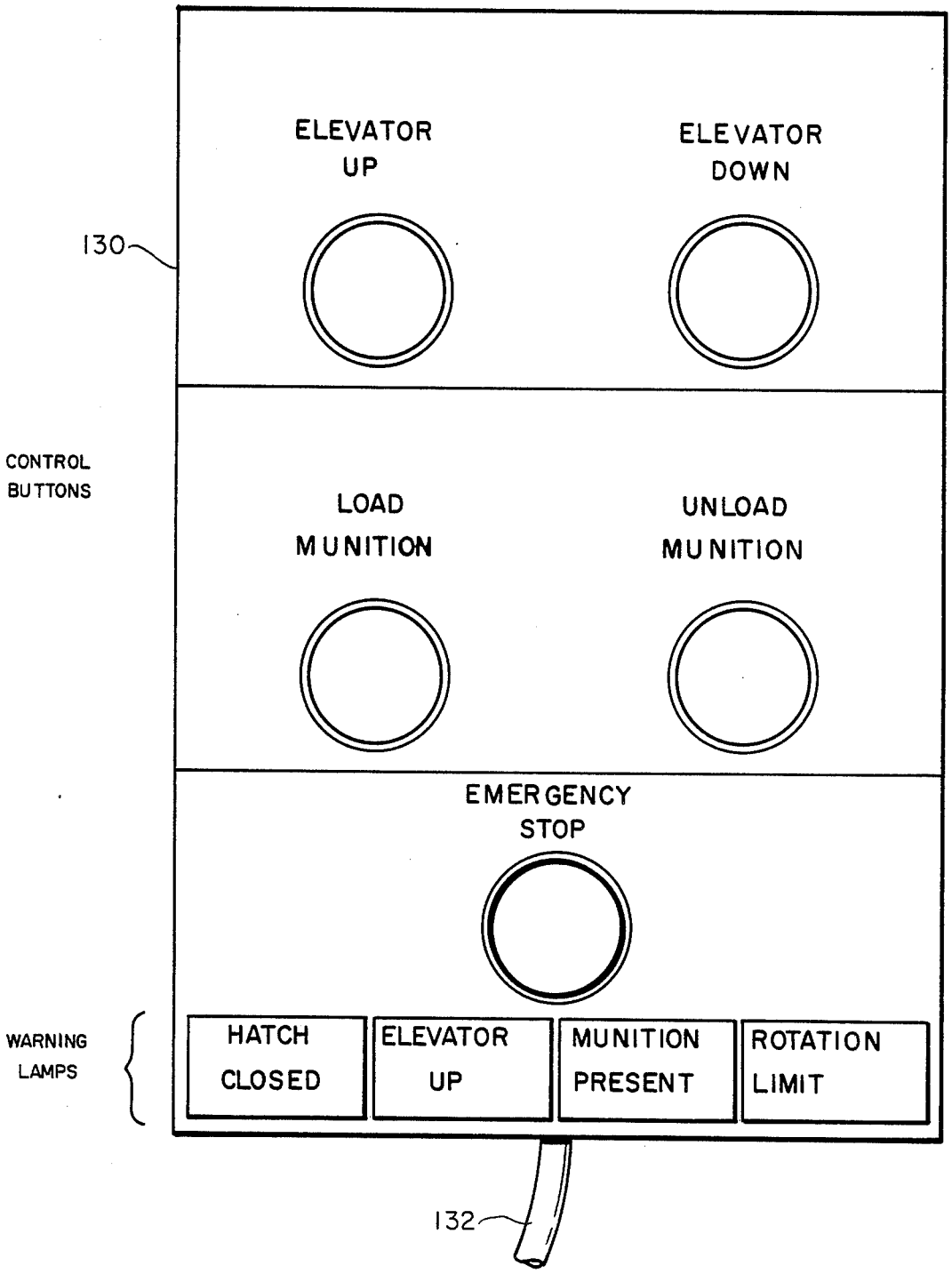
FIG. 19 illustrates a control panel of the type usable in connection with a microprocessor in order to bring about the desired interrelated movements of the rotary storage assembly and the elevator at the behest of the operator.

Obviously, there are at least two different ways in which are apparatus can be controlled in order that these desired results can be achieved. Preferably, we utilize a simplified operator's control panel 130, as shown in FIG. 19, upon which a series of push buttons and warning lamps are provided. As clearly visible in FIG. 19, the upper part of the panel 130 utilizes the buttons "elevator up" and "elevator down", whereas a mid portion of the control panel involves the "load munition" and "unload munition" buttons. As is obvious, pushing these buttons directly brings about the desired functions. Below latter buttons is the "emergency stop" button, which the operator is to push in case of a malfunction of an essential portion of our device, to stop elevator and cruciform operation so that corrective action can be taken.

Arrayed along the lower portion of the control panel are a series of warning lamps, these including "hatch closed", "elevator up", "munition present", and "rotation limit". The control panel is connected to the vehicle by a suitable "umbilical cord" 132, which umbilical cord connects the buttons and warning lamps to a suitable location in the respective munitions storage bay. Quite obviously, each of the rotary storage means 20 and 22 is equipped with its own control panel.

The control panels we use can also be more sophisticated than merely involving devices operated by push buttons. For example, we can use a controller such as made by Intel of Santa Clara, Calif., which could for example, be a Model 8748 with a 1K EPROM. This device utilizes a microprocessor chip that would be the centerpiece of a microprocessor assembly we would utilize in order to bring about certain programmed functions.

In addition, the Intel 8243 input-output expander can be used if more input-output connections are needed.

In embodiments of this type, we would connect the various motors and limit switch to the controller device so that it can perform the indicated checks, and carry out the intended functions.

Alternatively, we can of course use the less sophisticated system in which switch positions are indicated by signal lights, and motor operations are initiated directly in response to control button operations and terminated by switch reactions or button release.

We are aware during the offloading procedure, as two men on the deck of the vehicle are lifting the munitions from the elevator into the corresponding launch yoke, that some time will be lost, unless a third operator is on hand to summon the next munition from the Rotary Storage Magazine. More specifically, if only two deck operators are available, the elevator will remain in the raised position after the lifting of the munition therefrom, and in the usual case it will not descend for the next munition until one of the men involved in the loading procedure has pressed the appropriate button of the control panel illustrated in FIG. 19, to cause the descent of the elevator. This is of course to be followed by rotation of the cruciform assembly in the direction that will bring another munition around to Position A, the position directly below the hatch opening 40, so that the elevator can raise the munition to deck level.

Figure 17:
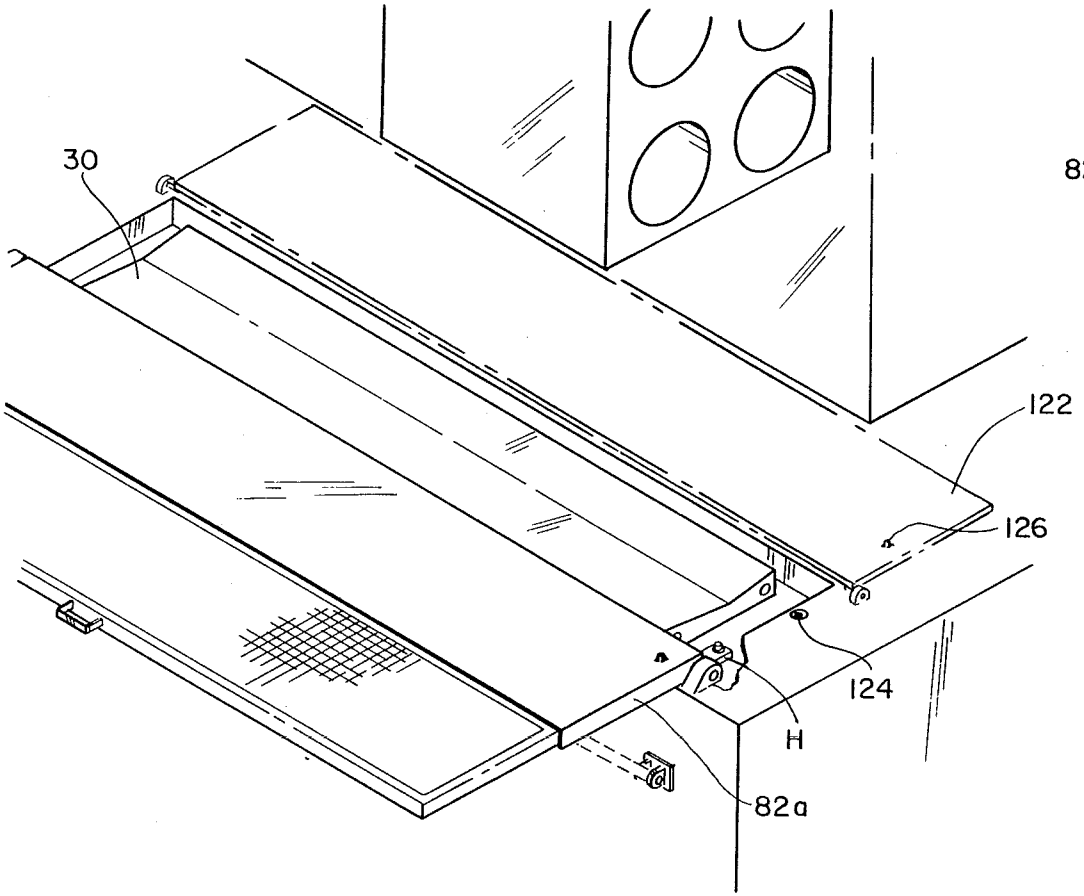
FIG. 17 is a perspective view of another embodiment of our invention, involving a lightweight closure for the hatch, with the placement of this lightweight closure over the hatch serving to bring about an expedited delivery of munitions to the deck during a yoke loading procedure.

We may use a modification of this invention of the type shown in FIG. 17, wherein a lightweight closure 122 is hingedly mounted on the long side of the hatch opening 40 directly opposite from the protective hatch member 82. Utilized in association with the lightweight closure is a slightly recessed deck switch 124, whose upstanding plunger is depressed by a protuberance 126 on the underside of closure 122 when the closure is moved to the closed position. Each time the lightweight closure moves down over the deck opening, the switch 124 closes, and this activates a multistep procedure, also known as an expedited delivery, wherein the control system serves automatically to bring about the descent of the elevator, followed by rotation of the cruciform assembly so as to bring the next munition to the location above the elevator and below the hatch opening 40. This positions the next munition in the "ready" position, so that it can be delivered promptly to the deck level upon the operator pressing the "elevator up" button of the control panel 130 illustrated in FIG. 19.

Figure 18:
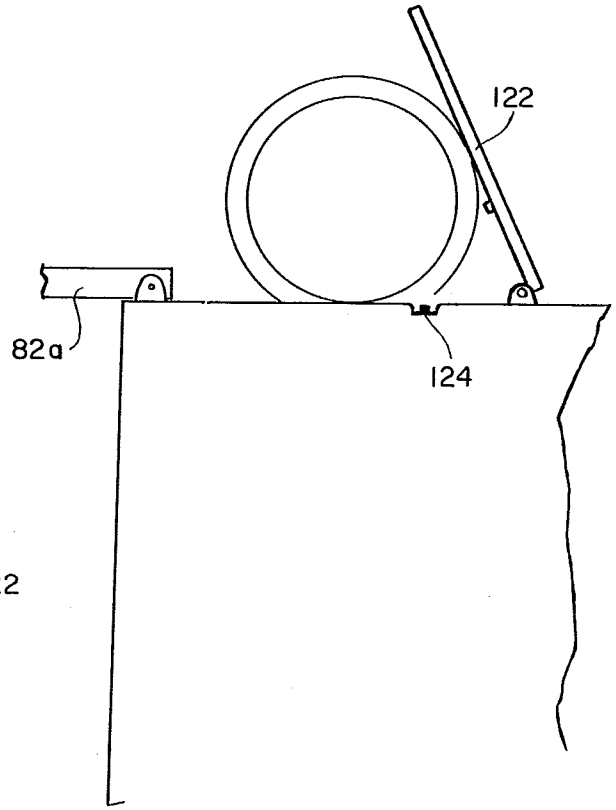
FIG. 18 is closely related to FIG. 17 in that it shows how a rising munition raises the lightweight closure, and brings about a cessation of the expedited delivery procedure.

FIG. 18 serves to illustrate how the rising missile can lift the lightweight closure 122, with this serving to release the deck switch 124. The upward elevator movement will continue until deck level is reached, where it will remain so that the operators can lift off the munition for insertion into the launching yoke. If the operators thereafter permit the lightweight closure to again close the hatch opening 40, this will close the switch 124 to automatically bring about another downward movement of the elevator, and the rotation of the cruciform assembly, so as to place the next munition on the elevator, thus accelerating the delivery of the next munition shortly after it is called for.

Figure 20:
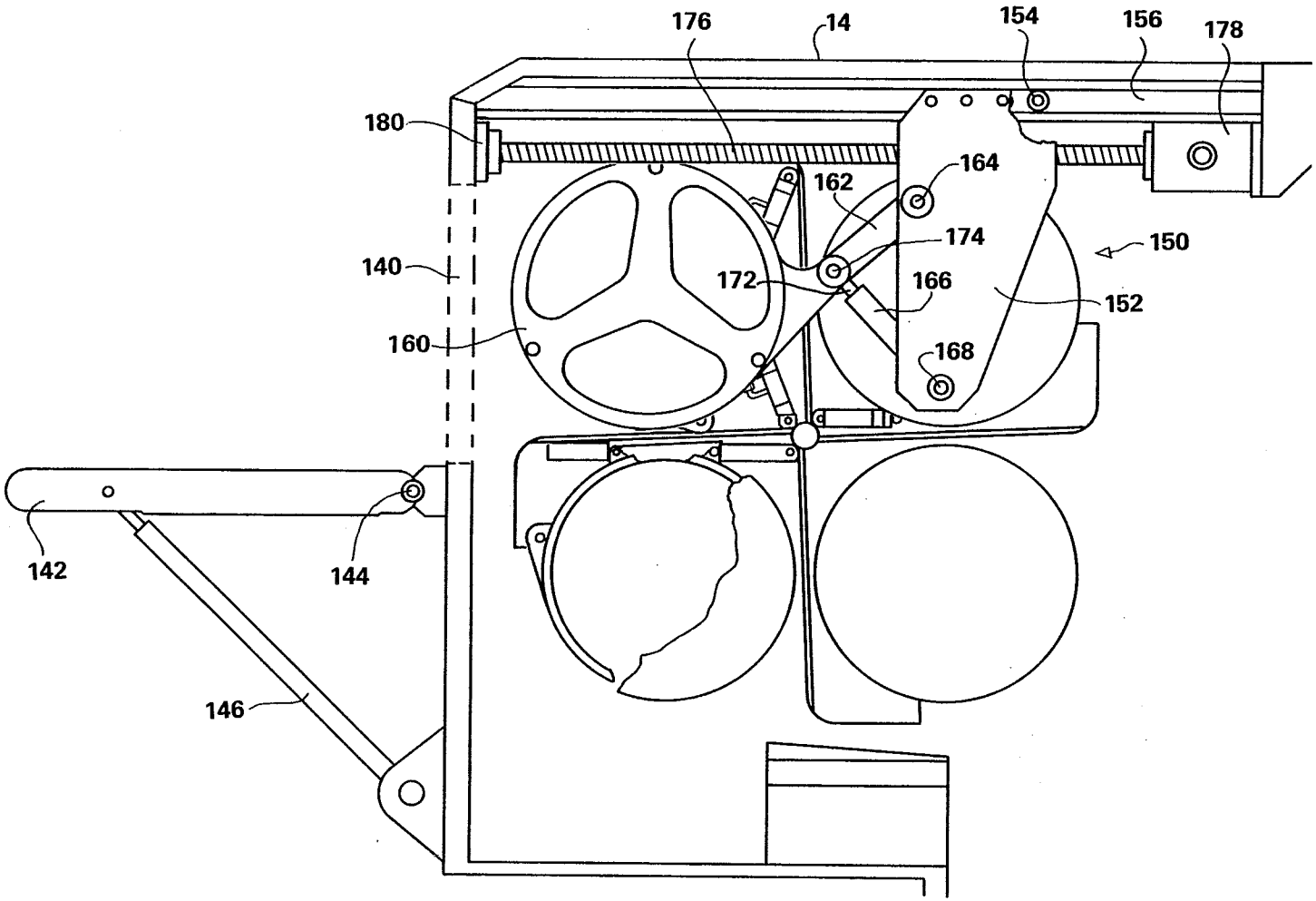
FIG. 20 is an embodiment of our invention involving the deck above the rotary storage magazine being unbroken, with loading and unloading of munitions from the rotary storage magazine being accomplished through a side opening by the use of a lateral conveyor.

Turning to FIG. 20, it is to be seen that we have there illustrated a substantially different embodiment of our invention, one in which the deck 14 directly above the multi-armed rotary support device is intact, and munitions are loaded and unloaded from the side, through an opening 140. However, the multiarmed rotary support assembly itself is substantially unchanged.

The lateral opening 140 is normally closed by an armored door 142, which is hinged at 144 and is preferably configured with a slight declevity extending along its longitudinal centerline. Therefore, when the door 142 has been moved to the substantially horizontal position shown in FIG. 20, there will be relatively little tendency of a munition resting on the door to roll off. The door 142 is preferably approximately 10 feet long, although the length can vary in accordance with the munitions being dealt with. A plurality of supports 146 may be utilized at spaced locations along the length of the door 142 in order that it may be properly supported when in the horizontal position.

Lateral movements of the munitions from positions resting on the door to installed positions on the arms of the rotary support assembly are brought about by a munition transporter in the form of a lateral conveyor 150, which device also serves on occasion to remove the munitions from the rotary support assembly.

The lateral conveyor involves devices used at the fore and aft ends of the weapons bay, only one of which devices is illustrated in FIG. 20. As seen in this figure, an elongate plate 152 equipped with an aligned plurality of rollers 154 along its upper edge is supported from a track or rail 156. The track 156 is essentially horizontally disposed, and resides just under the deck 14 of the vehicle in a direction perpendicular to the direction of vehicle travel.

As will be apparent, the plate 152 is paired with a substantially identical plate 153, with the two plates being mounted in a parallel relationship to each other. The two plates are mounted a spaced distance apart, as revealed in FIG. 21, and they serve as the support for a munition-engaging lift ring 160, whose diameter is slightly larger than the diameter of the missiles being stored by the rotary support assembly.

Figure 21:
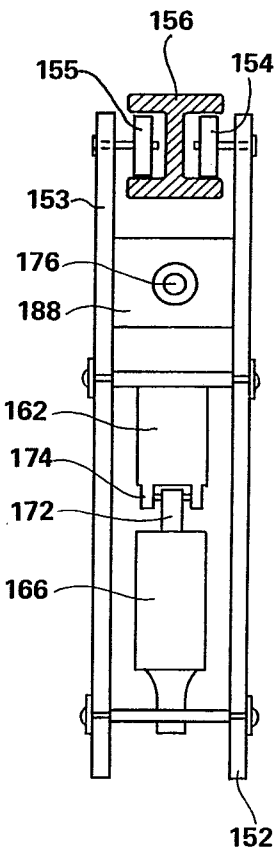
FIG. 21 is a fragmentary view to a somewhat larger scale of a portion of the support means for the lateral conveyor.

FIG. 21 reveals that plate 152 is supported from one side of track 156 by the use of rollers 154, whereas plate 153 is supported from the other side of the track 156 by the use of rollers 155.

From FIG. 20 it will be seen that the mounting for ring 160 is constituted by a single integral arm 162, which is pivotally mounted at point 164, and equally supported by the plates 152 and 153. It is to be understood that one ring 160 is located at the forward end of the weapons bay, and the other ring 160 is located at the aft end of the weapons bay.

As is also apparent from FIG. 20, an actuator 166 is pivotally mounted at 168 to plate 152, and of course, to plate 153 at the same corresponding location. The piston portion 172 of the actuator is pivotally attached to the arm 162 at mounting point 174. The actuator 166 makes possible the raising of the respective munition-engaging lift ring at the proper time, which lifting is accomplished when the piston portion of the actuator is caused to extend. The actuator 166 can be hydraulic or pneumatic, or even electrically powered if desirable.

It may be presumed in FIG. 20 that a third munition has been delivered by the lateral conveyor 150 to the rotary support assembly, and the rotary support assembly rotated clockwise 90°, leaving only a single location on the rotary support assembly to be filled. In order that this may be accomplished, the lateral conveyor is moved outwardly to the position shown in FIG. 22, where the munition-engaging lift ring is outboard of the side of the vehicle, and directly above the armored door 142. This movement of the portion of the lateral conveyor at each end of the weapons bay may be brought about by the use of a threaded ball screw actuator 176 of the type described in connection with FIG. 2, except that device 176 of course extends horizontally rather than vertically. A respective bidirectional motor 178 drives each screw actuator in rotation, which motor may for example be powered hydraulically, pneumatically, or electrically. The active or threaded portion of the actuator 176 engages and interacts with a member 188 located between the plates 152 and 153, and the end of the actuator rod 176 remote from the motor 178 is supported in an appropriate bearing 180. Therefore, as the actuator rod 176 rotates clockwise, the respective lateral conveyor portion moves along the track or rail 156 in one direction, whereas when the actuator rod rotates counterclockwise, this portion of the lateral conveyor moves in the other direction along the track or rail 156.

Each munition-engaging lift ring 160 is equipped with a plurality of pin units 182 that are electrically operated, with each unit containing a pin movable between recessed and extended positions. When the end of a missile is to be engaged, and the rings 160 brought alongside the ends of the munition, the pin units 182 are actuated so as to cause the pins 184 to extend out of the plane of the ring, into contact with an encircling collar-like member 186 disposed around the end of the missile. The member 186 has a continuous slot around its circumference, making it unnecessary to rotate a munition to any particular rotation in order that the pins can be received.

Figure 23:
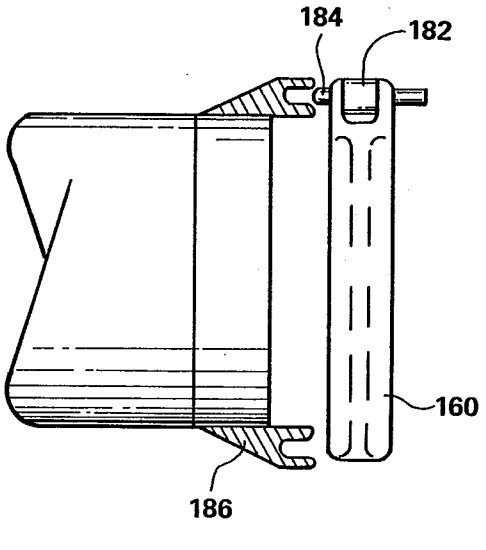
FIG. 23 is a fragmentary longitudinal view of a munition whose ends are to be engaged by pins of the cooperating pair of lift rings of our lateral conveyor.
Figure 23:
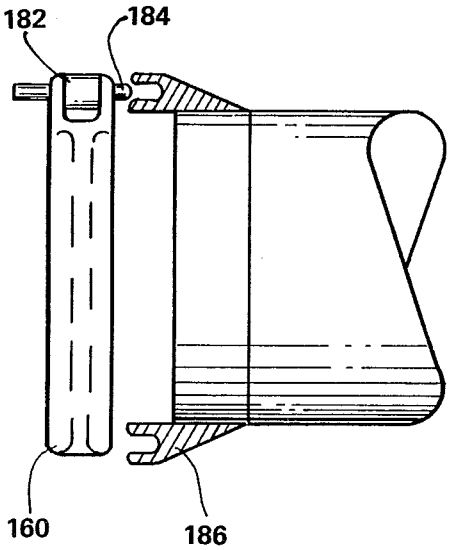

Turning to FIG. 23, it will there be seen that we have shown a fragmentary side elevational view of a munition, with a collar-like member 186 on each end of the munition. In this figure it will be noted that the extending of the pins 184 enables the munition to be supported by the pair of lift rings 160.

Therefore, in the loading of the rotary storage magazine in accordance with this embodiment of our invention, each munition is lifted onto the armored door 142 after this door has been placed in the open or extended position in which it forms a generally horizontally disposed platform.

Figure 22:
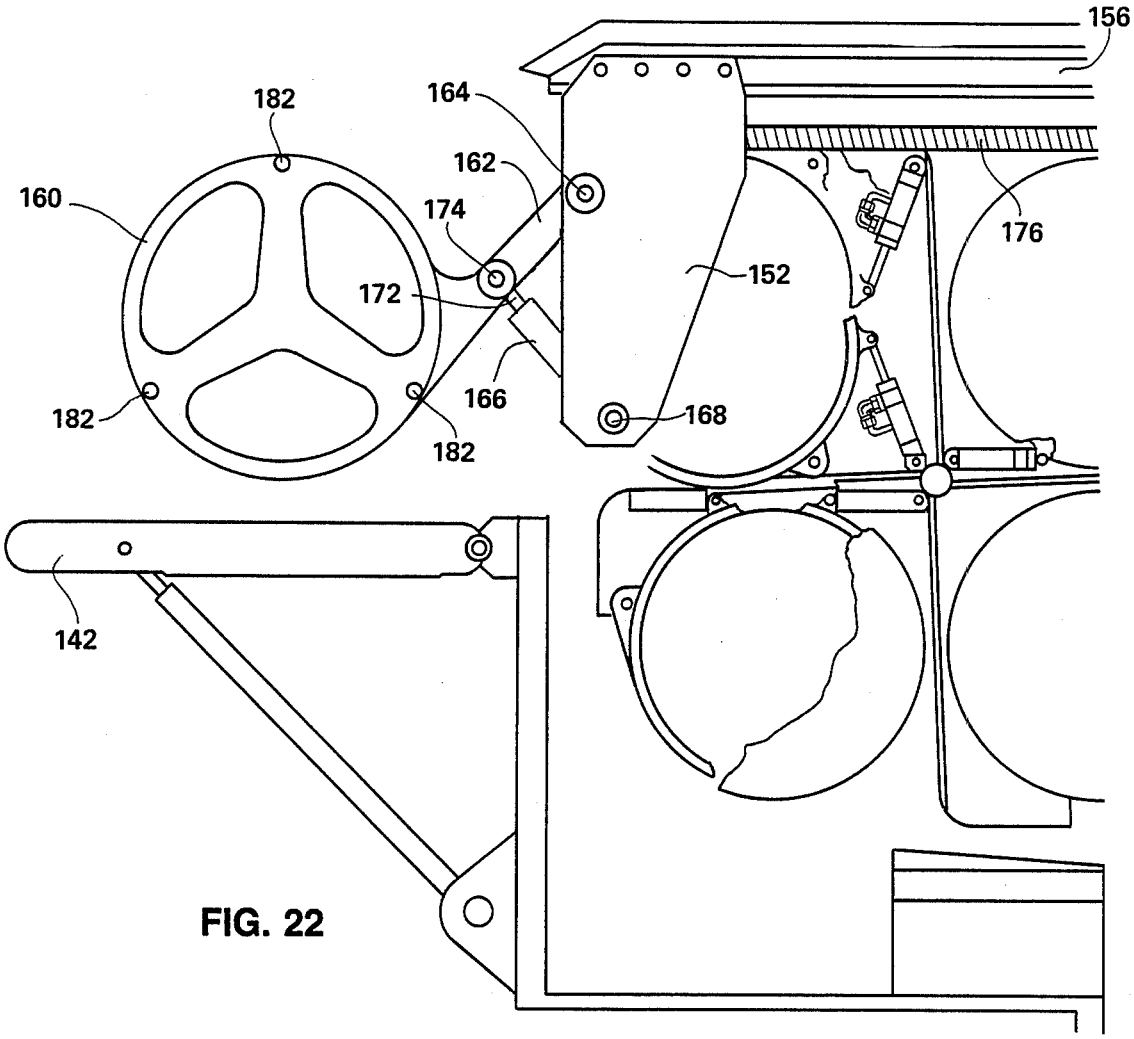
FIG. 22 is a view similar to FIG. 20 but showing the lateral conveyor moved outboard, and showing one of a pair of lift rings used for moving and lifting munitions.
Figure 22A:
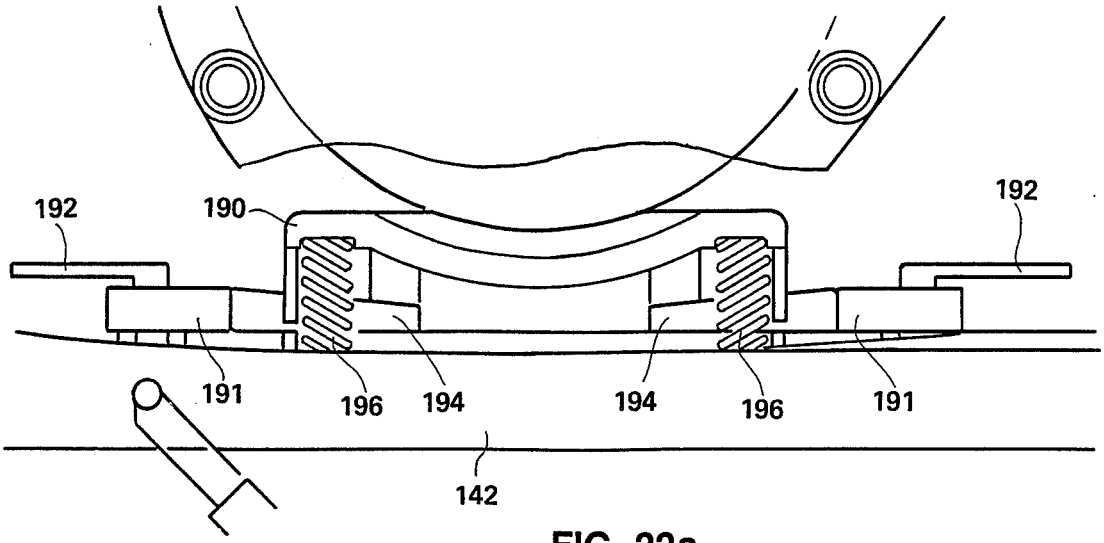

If desired, a positioning device 190 of the type illustrated in FIG. 22*a* can be incorporated into an interior portion of door 142, which device can be selectively positioned so as to lift the munition in order to simplify the pins or fingers 184 engaging the collar-like members 186 located on the ends of the munition. The positioning device 190 is normally retracted against the inner surface of the door 142, by the action of tension springs 196.

Cam members 191 operated by handles 192 are arranged to cause slidably mounted wedges 194 to move toward each other on occasion, so as to cause the raising or extending of the active or munition-engaging part of the device 190 prior to it receiving the munition, so that the collar-like members 186 of the munition will be in the most ideal position for receiving the fingers 184 during a loading procedure.

Thereafter, the handles 192 are operated to rotate the cams in the opposite direction, so as to enable the wedges 194 to move apart under bias of springs (not shown), so that the springs 196 can move the device 190 out of the way, in order that it will not interfere with the lateral conveyor 150 moving the munition inwardly through the opening 140.

In order to bring about the desired positioning of the rings 160 with respect to the munition, the motor 178 is actuated, so as to cause the actuator 176 to drive the rings 160 of each part of the lateral conveyor to the outboard position illustrated in FIG. 22. The pin units are then actuated so as to cause the pins 184 thereof to extend and to engage the collar-like members located on the ends of the munitions, such as on the canisters used in connection with certain missiles. Upon the pins 184 of the two munition-engaging rings then firmly engaging the munition, it can then be drawn into the multi-armed rotary support assembly 23, where it is received by the restraint arms of the next available set of support arms. At this point, the pins 184 are withdrawn from contact with the munition, and both of the munition-engaging lift rings can then be placed in an appropriate storage location. The rotary support assembly can be freely rotated at this time.

At such time as munitions are to be delivered to the deck of the vehicle or structure, the fore and aft portions of the lateral conveyor 150 are actuated so as to cause the munition-engaging lift rings to move alongside the ends of the munition residing in Position A of the rotary support assembly. The pin units 182 are then energized so as to cause the pins 184 to engage both ends of the munition. The restraint arms of the rotary storage units are caused to release the munition, and the motor 178 of the lateral transporter is then actuated so as to cause the munition to be delivered to a location outboard of the vehicle or structure.

Figure 25:
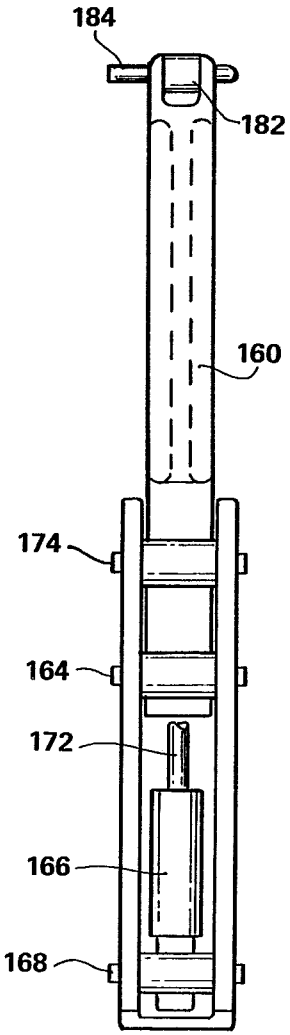
FIG. 25 is a fragmentary view to a somewhat larger scale, showing other portions of the lateral conveyor.
Figure 24:
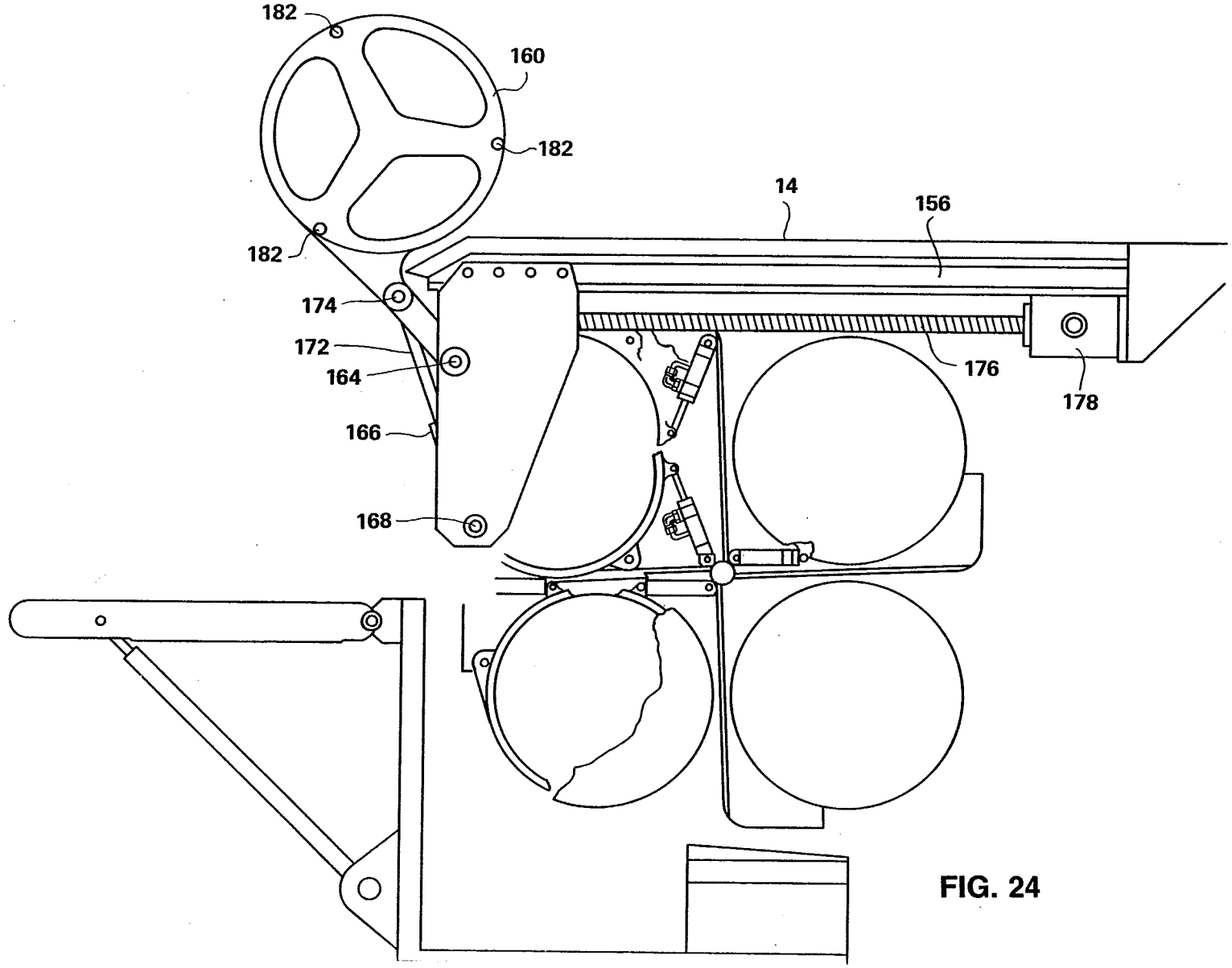
FIG. 24 is a view similar to FIGS. 20 and 22, but revealing how a pair of lift rings is utilized for raising a munition to a location slightly above the deck level of the vehicle or structure.

FIG. 24 reveals how a simultaneously actuated pair of rings 160 can lift a munition from the outboard position, to a location slightly higher than the deck, so as to simplify the positioning of the munition for ready reloading of the weapon, such as a launcher yoke. The lifting of the munition is of course accomplished by energizing both actuators 166 such that their piston members 172 extend, thus causing both arms 162 to move upwardly while pivoting about the point 164. FIG. 25 reveals additional details of the upward movement of a lift ring 160.

Upon the pin units 182 being deenergized, the pins 184 are withdrawn from engagement with the munition, permitting the munition to be loaded into the launch yokes, and enabling the lift rings 160 to be returned to lowered position preparatory to moving alongside the next available munition for engaging the ends of same.

As is obvious, our lateral transporter portions can be moved along the track or rail 156 as needed in order to move munitions into, or out of, the rotary support assembly. Also, by the energization of the actuators 166 when the lateral conveyor is in its outboard location, a munition engaged by the pair of lift rings 160 can be readily and rapidly lifted to the deck of the vehicle or structure.

Figure 26:
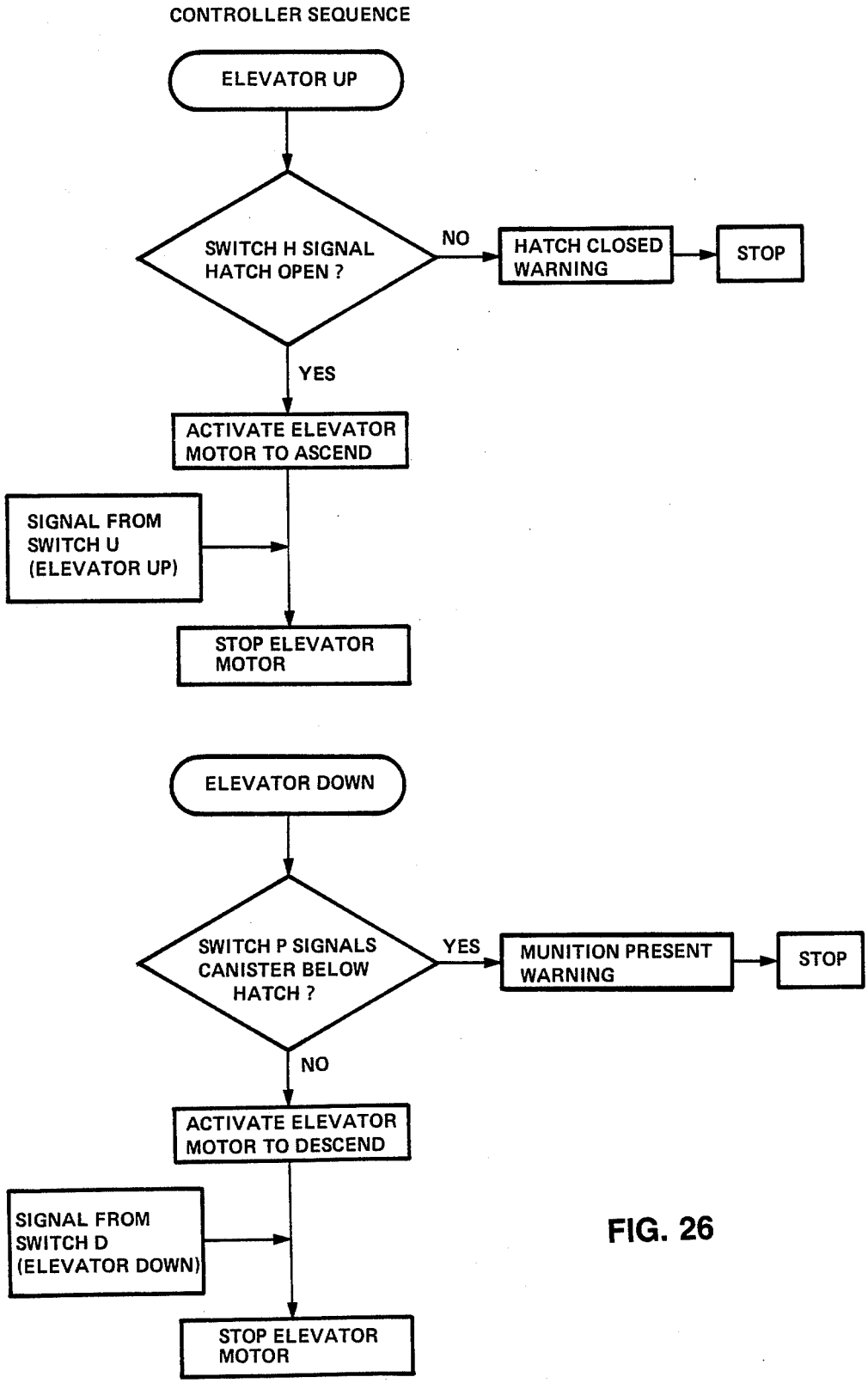
FIG. 26 is a somewhat simplified flow diagram of the controller sequence involved when the elevator of the preferred embodiment raises and lowers.

In FIG. 26, we have shown in connection with our preferred embodiment, flow diagrams of the controller sequence during elevator rising and elevator lowering procedures. As will be noted during the elevator ascent procedure, the elevator top limit switch, switch U, is depicted as stopping the elevator motor, whereas during the elevator lower procedure, the elevator lower limit switch, switch D, is depicted as stopping the elevator motor.

In flow diagram 27, we show the controller sequence in connection with the adding of munitions to the rotary storage assembly, with the fully loaded limit switch, switch F, being responsible for stopping rotation of the rotary storage assembly during loading, although it is obvious that alignment switch A also serves to stop cruciform assembly rotation during the intermediate conditions.

Lastly, in flow diagram 28, we show during the munition removal procedure, that the elevator switch D serves to stop the elevator during its downward movement, whereas the alignment switch A serves to stop the rotary storage assembly at appropriate locations when the second and third munitions are being offloaded. In this instance, the limit switch E serves to stop cruciform rotation as the last munition is being delivered.

Figure 29:
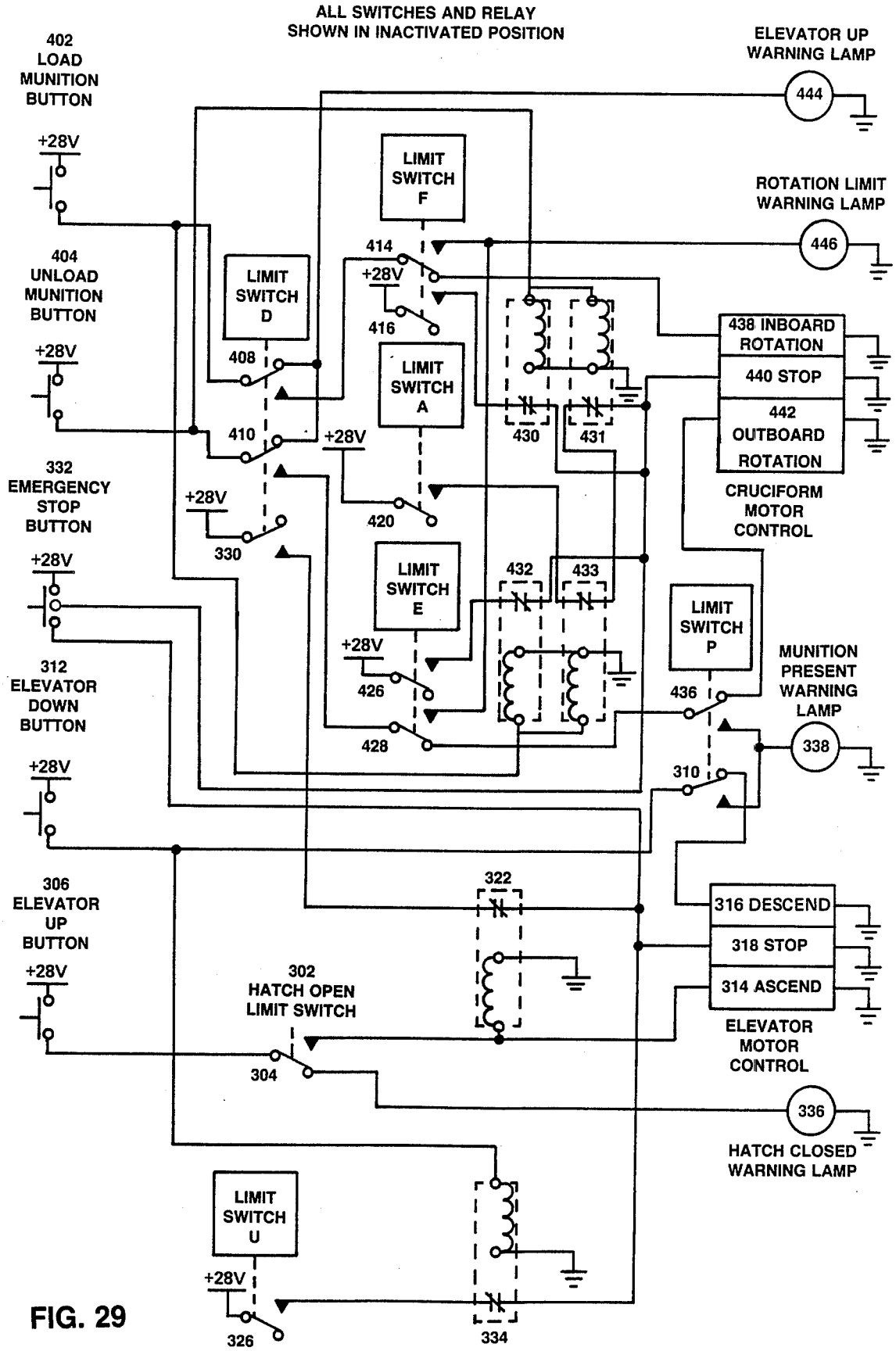
FIG. 29 is a schematic wiring diagram of the control system we prefer to use in connection with the primary embodiment of our invention.

Reference is now made to FIG. 29, in which we set forth a schematic wiring diagram relatable to the primary embodiment of our Rotary Storage Magazine. This diagram will be described in terms of the operation of the various components, including the elevator 30.

Elevator Operation

1. The operator opens the top hatch.

2. "Hatch Open" switch 302 closes relay 304 in the elevator ascend control circuit.

3. The operator pushes "Elevator Up" button 306, to energize the elevator ascend control circuit with 28 volts.

4. "Elevator Up" signal passes through the now closed "Hatch Open" relay contact 304 to activate elevator motor ascend switch 314. Elevator ascend switch 314 is a latching relay that keeps the motor 50 rotating and the elevator ascending until an input activates the stop switch 318.

5. The "Elevator Up" button 306 is also connected to a relay 322, normally closed, which operates to disconnect the signal from Limit Switch "D" from the motor stop switch 318. Thus, while the button 306 is held down, the stop signal from Limit Switch "D" is disconnected. This allows the motor 50 to turn until the stop switch 318 has been reset, at which time the "Elevator Up" button may be released by the operator. The signal from the emergency stop button 332 is not affected by relay 322.

6. When the Limit Switch "U" is activated by the elevator hitting the top position, the signal is transmitted through the contact 326 of Limit Switch "U" relay to the elevator stop switch 318, which shuts off and locks the elevator in the up position.

7. Operators load a munition onto the raised elevator.

8. An operator pushes the "Elevator Down" button 312.

9. If there is no munition below the elevator, the Limit Switch "P" is not activated and its relay contact 310 is in its normal position of permitting completing the "Elevator Down" circuit.

10. The "Elevator Down" signal passes through closed Limit Switch "P" relay contact 310 to the elevator motor descend switch 316. The elevator motor descend switch is a latching relay that keeps the elevator motor rotating in the descending direction until the stop switch 318 is activated.

11. The "Elevator Down" button is also connected to a relay 334, normally closed, which disconnects the Limit Switch "U" signal to the motor stop switch. Thus, while the button is held down, the stop signal from Limit Switch "U" is disconnected. This allows the motor to turn until the stop switch has been reset, at which time the "Elevator Down" button may be released by the operator. The latching relay in the motor descend switch keeps the motor running. The signal from the emergency stop button 332 is not affected by relay 334.

12. When the Limit Switch "D" is activated by the elevator hitting the bottom position, the signal is transmitted through the Limit Switch "D" relay contact 330 to the elevator stop switch 318, which shuts the elevator motor off and locks the elevator in the down position.

13. It is to be noted that if the hatch is closed and the "Hatch Open" switch 302 is activated, the "Hatch Open" relay 304 disconnects the "Elevator Up" circuit and connects to a "Hatch Closed" warning signal 336. The "Hatch Closed" warning signal is activated if the "Elevator Up" button is then pushed.

14. It is also to be noted if the Limit Switch "P" is activated, the Limit Switch "P" relay contact 310 disconnects the "Elevator Down" circuit and connects to a "Munition Present" warning signal 338. Accordingly, the "Munition Present" warning signal is activated if the "Elevator Down" button is then pushed.

15. If the "Emergency Stop" button is pushed, it activates the elevator and rotary storage assembly motor stops 318 and 440, shutting off either operation. To continue, the desired function button must then be re-pushed.

Rotary Storage Assembly Operation

1. The rotary storage assembly operation procedure is used after an operator has loaded a munition into the rotary assembly in position A directly below the hatch. The operator wishes to rotate the rotary storage assembly to move the munition from position A to position B (rotate inboard).

2. The operator pushes the "Load Munition" button 402.

3. The Limit Switch "D", activated when the elevator is in the down position, closes relay contact 408 in the rotary storage inboard rotation control circuit, connecting 28 volts to activate the rotary storage motor Inboard Rotation Switch 438 of motor 60. The relay 408 normally disconnects the rotation circuit when Limit Switch "D" is not activated.

4. The Limit Switch "F", activated when the rotary storage assembly is in the fully loaded orientation, opens a relay 414 in the rotary storage inboard rotation control circuit to prevent operation. However, the relay contact 414 normally completes the circuit when Limit Switch "F" is not activated.

5. The "Load Munition" button 402 is also connected to relays 432 and 433. These relays open the circuits from relay 426 on Limit Switch "E" and relay 420 on Limit Switch "A", which connect to the rotary storage motor stop switch 440. Thus, while the "Load Munition" button is held down, any stop motor signal from Limit Switch "E" or Limit Switch "A" is disconnected. Relays 432 and 433 allow the motor to turn until the stop switch has been reset, at which time the "Load Munition" button may be released by the operator. The latching relay in the motor inboard rotation switch 438 keeps the motor running until the stop signal is triggered. The "Emergency Stop" button 332 is not affected by relays 432 or 433.

6. The rotary storage assembly rotates until Limit Switch "A" or Limit Switch "F" is activated, closing associated relay 420 or 416. When activated, either limit switch closes a circuit, sending a signal to the stop switch 440 of the rotary storage assembly motor, stopping its rotation and locking the rotary storage assembly in position.

7. If the Limit Switch "D" is not activated, the Limit Switch "D" relay 408 disconnects the rotary storage rotation control circuit and connects to an "Elevator Up" warning signal. Thus, the "Elevator Up" warning signal is activated when the "Load Munition" button is then pushed. This arrangement prevents rotation when the elevator is up.

8. If the Limit Switch "F" is activated, the Limit Switch "F" relay 414 disconnects the rotary storage inboard rotation control circuit and connects to a "Rotation Limit" warning signal 446. Thus, the "Rotation Limit" warning signal is activated when the "Load Munition" button is then pushed. This arrangement prevents inboard rotation when the rotary storage assembly is in the fully loaded orientation.

9. If there is no munition in position A and the operator wishes to unload the munition in position B, he must rotate the rotary storage assembly in the outboard direction to move the munition from position B to position A.

10. The operator pushes the "Unload Munition" button 404.

11. The Limit Switch "D", when activated, closes relay contact 410 in the rotary storage outboard rotation control circuit. The relay normally disconnects the circuit when Limit Switch "D" is not activated. Limit Switch "D" is activated when the elevator is in the down position.

12. The Limit Switch "E", when activated, opens a relay contact 428 in the cruciform outboard rotation control circuit. The relay normally connects the circuit when Limit Switch "E" is not activated. Limit Switch "E" is activated when the rotary storage assembly is in the fully empty orientation. This arrangement prevents outboard rotation when the rotary storage assembly is in the empty orientation.

13. The Limit Switch "P", when activated, opens relay 436 in the rotary storage outboard rotation control circuit. The relay normally connects the circuit when Limit Switch "P" is not activated. Limit Switch "P" is activated when a munition is in position A. This arrangement prevents outboard rotation when a munition is in position A.

14. The "Unload Munition" button 404 sends a signal through the closed relays 410, 428 and 436 of Limit Switches "D", "E", and "P", respectively, to activate the rotary storage assembly motor outboard rotation switch 442.

15. The "Unload Munition" button is also connected to relays 430 and 431. These relays open the circuits from relay 416 on Limit Switch "F", and relay 420 on Limit Switch "A", which connect to the rotary storage assembly motor stop switch 440. Thus, while the "Unload Munition" button is held down, any stop motor signal from Limit Switch "F" or Limit Switch "A" is disconnected. Relays 430 and 431 allow the motor to turn until the stop switch has been reset, at which time the "Unload Munition" button may be released by the operator. The latching relay in the motor outboard rotation switch 442 keeps the motor running until the stop signal is triggered. The "Emergency Stop" button 332 is not affected by the relays 430 or 431.

16. The rotary storage assembly rotates until Limit Switch "A" or Limit Switch "E" is activated, closing associated relay 420 or 426. When activated, the Limit Switch sends a signal to the stop signal 440 of the rotary storage assembly motor, stopping rotation and locking the assembly in position.

17. If the Limit Switch "D" is not activated, the Limit Switch relay 410 disconnects the rotary storage rotation control circuit and connects to an "Elevator Up" warning signal. The "Elevator Up" warning signal is activated when the "Unload Munition" button is then pushed. This prevents rotation when the elevator is up.

18. If the Limit Switch "E" is activated, the Limit Switch "E" relay 428 disconnects the rotary storage outboard rotation control circuit and connects to a "Rotation Limit" warning signal 446. The "Rotation Limit" warning signal is activated when the "Unload Munition" button is then pushed. This prevents outboard rotation when the rotary storage assembly is in the empty orientation.

19. If the Limit Switch "P" is activated, the Limit Switch "P" relay 436 disconnects the rotary storage outboard rotation control circuit and connects to a "Munition Present" warning signal 338. The "Munition Present" warning signal is activated when the "Unload Munition" button is then pushed. This prevents outboard rotation of the rotary storage assembly when a munition is present in position A.

20. If the "Emergency Stop" button is pushed, it activates the elevator and rotary storage assembly motor stops 318 and 440, shutting off either operation. If thereafter desired to continue, the appropriate function button must then be pressed.

With regard to the lateral loading embodiment of our invention, it is to be recognized that the wiring diagram of FIG. 29 would need to be changed only in relatively minor ways, such as for the lateral loader to be manipulated instead of the elevator, and to change the ascend and descend functions to "extend" and "retract". Also, an additional control and feedback circuit would be required for the pivoting of the munition from the lateral opening 140 up to deck level.

Figure 27:
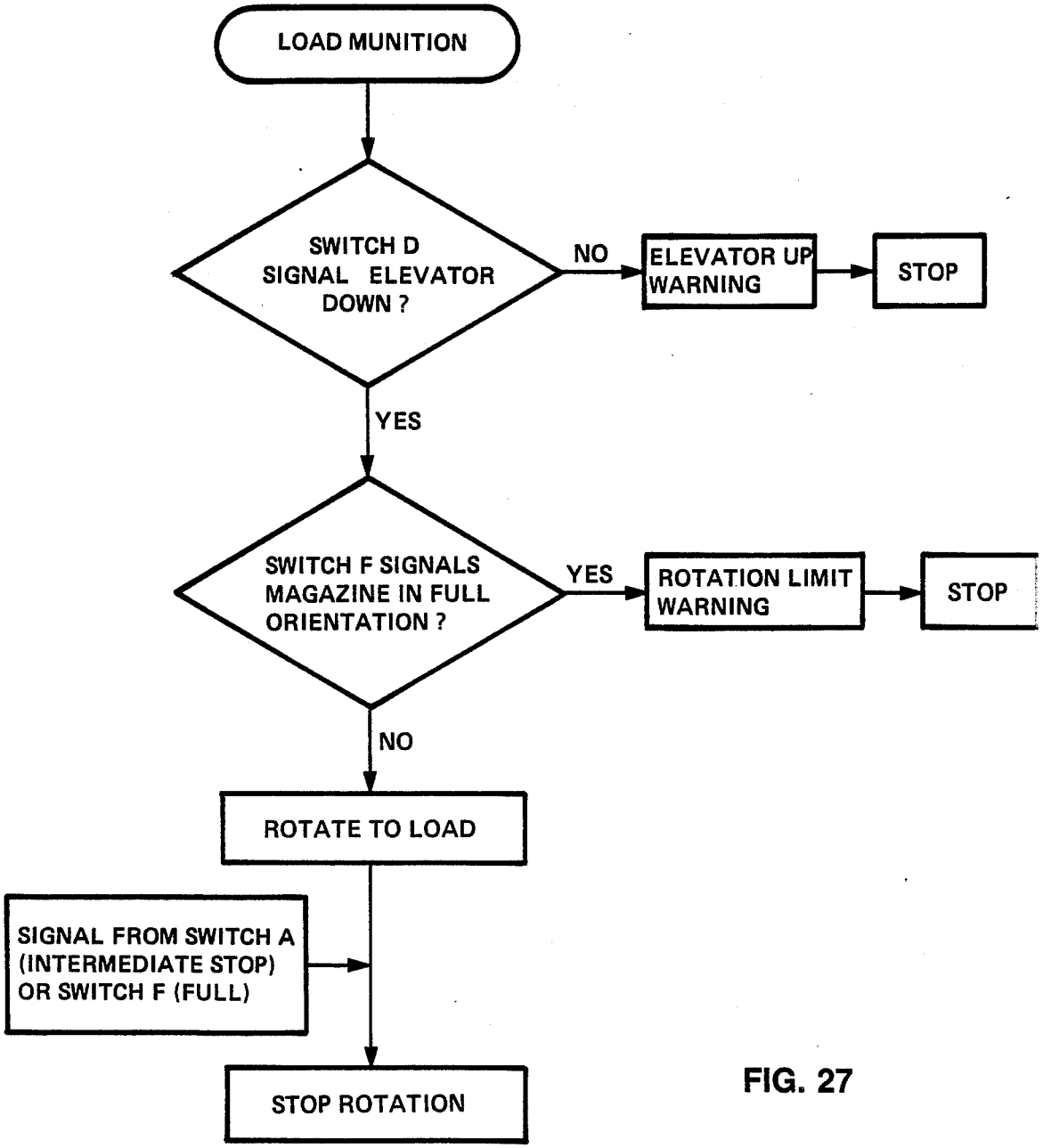
FIG. 27 is another simplified flow diagram of the controller sequence when munitions are being added to the storage magazine.
Figure 28:
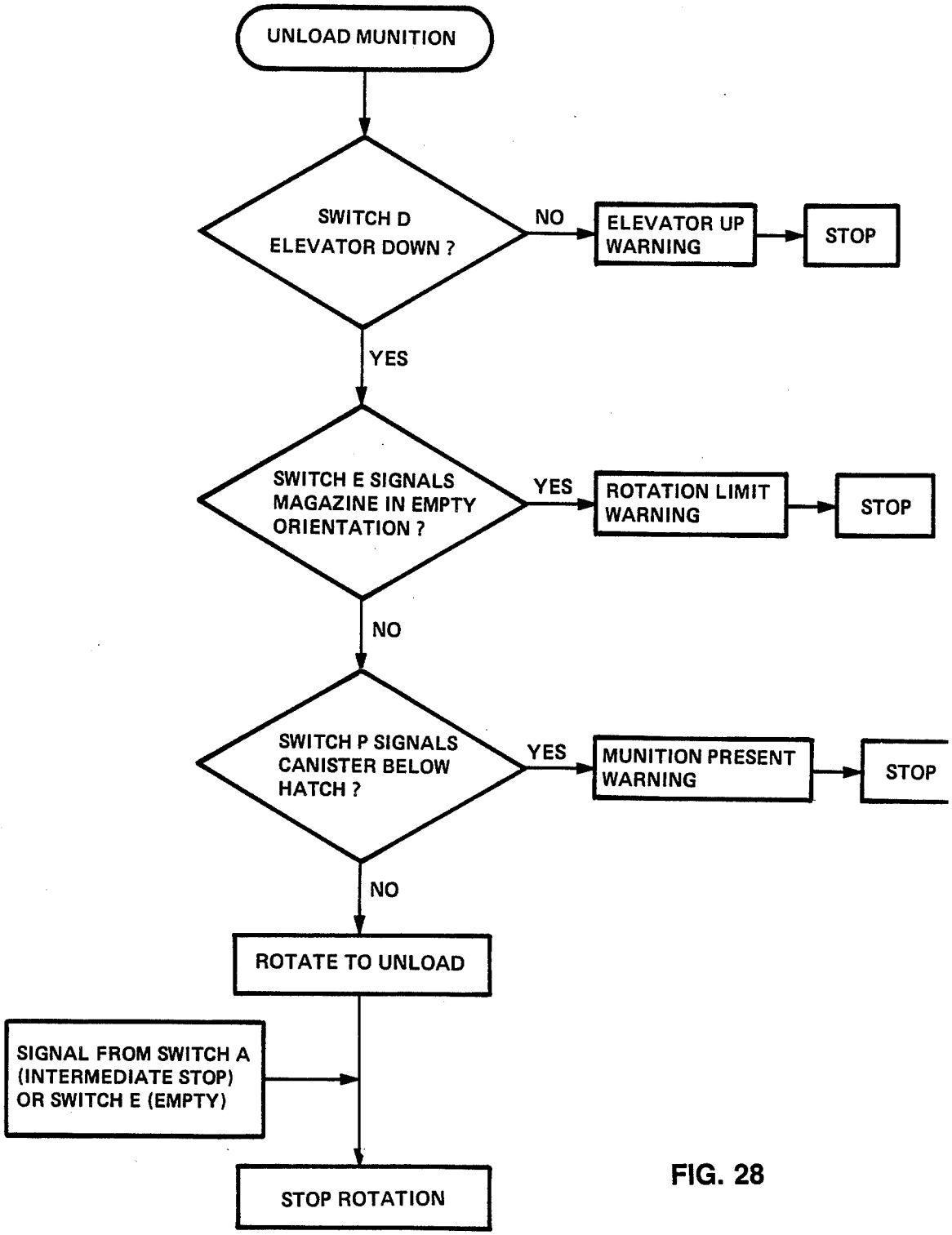
FIG. 28 is still another simplified flow diagram involving the removal of munitions from the storage magazine.

Similarly, the flow diagrams of FIGS. 26 through 28 are relevant to our lateral loading embodiment, except that up and down should be taken to be "extend" and "retract". The upward movement of the lift rings 160 depicted in FIG. 24 is intended to be included in the "extend" function.

We claim:

1. In an ordnance apparatus having a generally horizontal deck, a munitions storage bay below the deck, and a weapon on the deck, a rotary storage magazine generally aligned with the longitudinal centerline of the ordnance apparatus and operably disposed in said munitions storage bay, said rotary storage magazine usable such that munitions may be stored and thereafter quickly delivered on an as-needed basis to an intermediate position for the reloading of the weapon, said rotary storage magazine comprising multi-armed rotary support devices disposed in a fore-and-aft relationship immediately below deck level in said munitions storage bay, said rotary support devices being located a spaced distance apart, which distance is less than the length of the munitions to be stored, said rotary support devices each having the same number of support arms, such that a like number of munitions disposed in a generally parallel array may reside between corresponding support arms of the fore and aft rotary support devices, said rotary support devices being rotatable together, and having a common axis of rotation disposed in substantial parallelism with the longitudinal centerline of the apparatus, means in said munitions storage bay for driving said rotary support devices in one rotative direction during the loading of munitions into the storage magazine, and for driving said rotary support devices in the opposite direction during the delivery of the munitions for reloading of the weapon, and a munition transporter contained between said rotary support devices and spaced laterally from said axis of rotation of said rotary support devices, said munition transporter being in the form of an elevator movable between an upper position and a lower position, such that it can selectively move munitions down to said multi-armed rotary support devices during the loading of the storage magazine, and up away from said multi-armed rotary storage devices during the delivery of munitions of the loading of the weapon, said elevator, when in its lowered position, being located between circumferentially adjacent munition storage locations.

2. The rotary storage magazine as recited in claim 1 in which said multi-armed rotary support devices are of cruciform configuration.

3. The rotary storage magazine as recited in claim 1 in which said intermediate position is on the deck, alongside the weapon to be reloaded.

4. The rotary storage magazine as recited in claim 1 in which releasable restraint arms are utilized upon the support arms of said rotary support devices, said restraint arms being normally closed, such that the munitions cradled in said support arms will not be dislodged during rotation of said rotary support devices.

5. The rotary storage magazine as recited in claim 4 wherein said restraint arms are open at the time when a munition is to be received, and means for automatically opening said arms when the munition is to be unloaded.

6. The rotary storage magazine as recited in claim 1 in which said elevator is elongated generally parallel to the axis of rotation of said rotary support device, is operatively associated with an elongate deck opening, and serves to lift munitions therethrough one at a time to the deck level.

7. The rotary storage magazine as recited in claim 6 in which said elevator, when disposed at deck level, serves a distinct safety measure by substantially closing the deck opening, thus preventing any operator from falling into such opening.

8. The rotary storage magazine as recited in claim 6 in which a protective hatch cover normally covers the elongate deck opening when munitions are not being loaded or offloaded.

9. The rotary storage magazine as recited in claim 8 in which an interlock prevents said elevator when loaded with a munition from ascending when said protective hatch cover is closed.

10. The rotary storage magazine as recited in claim 6 in which a hingedly mounted lightweight cover is operationally associated with the elongate deck opening, such that it may serve as a closure therefor, said lightweight cover, when in a position closing said deck opening, being readily moved aside by a munition being lifted toward deck level by said elevator.

11. The rotary storage magazine as recited in claim 10 in which an electrical switch is operatively associated with and actuated by said lightweight cover, which electrical switch is a part of a circuit that, when actuated, serves to cause said elevator to go down, and said rotary storage device to rotate at the proper time, such that the next munition contained in said rotary storage magazine will be automatically positioned for thereafter being lifted to deck level.

12. The rotary storage magazine as recited in claim 6 in which releasable restraint arms are utilized with respect to each support arm of each of said rotary support devices, such that munitions will not be dislodged during rotation, the movement of said elevator serving to automatically effect release of said restraint arms at the appropriate instant during the loading procedure as well as during the offloading procedure.

13. The rotary storage magazine as recited in claim 6 in which interlock means utilized in connection with said elevator and rotary support devices serve to prevent said elevator from descending into contact with a munition supported by said rotary support devices.

14. The rotary storage magazine as recited in claim 13 in which releasable restraint arms are utilized with respect to each support arm of each of said rotary support devices, such that munitions will not be dislodged during rotation of said rotary support devices, and means for automatically releasing said restraint arms at the appropriate instant in order to permit loading as well as offloading.

15. The rotary storage magazine as recited in claim 6 in which interlock means utilized in connection with the drive for said rotary support device serves to prevent rotation of said device in the loading direction after the arms of said device are full of munitions, or rotation thereof in the unloading direction after such arms have already been emptied by munitions.

16. The rotary storage magazine as recited in claim 6 in which a control system is utilized therewith, said control system including a control panel having a limited number of operator inputs thereon, which enable the raising and lowering of the elevator, and the rotation of said rotary support devices to be carried out in a properly interrelated manner, without undue intervention by the operator.

17. The rotary storage magazine as recited in claim 16 in which a foldable, lightweight closure member is utilized, which lightweight closure member is hinged adjacent said elongate deck opening, said lightweight closure member, when moved to the position closing said deck opening, closing an electrical switch serving to bring about a certain sequence of operations, these including the downward movement of the elevator from the raised position, and the subsequent rotation of said rotary support devices in the direction that will serve to place the next munition upon said elevator.

18. The rotary storage magazine as recited in claim 1 in which said ordnance apparatus has a left side and a right side, and said rotary storage magazines are used in pairs, one on the left side and one on the right side of the apparatus.

19. The rotary storage magazine as recited in claim 1 in which a control system utilizing a plurality of limit switches is utilized, said control system serving to prevent damaging or undesired operation of either said munition transporter or said rotary support devices.

20. The ordnance apparatus as recited in claim 1 in which said munition transporter is operative in timed relation with said rotary support devices.

21. In an ordnance apparatus having a generally horizontal deck, a pair of munitions storage bays below the deck, and at least one weapon on the deck, a pair of rotary storage magazines usable below deck level on both sides of the apparatus, at locations symmetrically disposed with respect to the centerline of the apparatus, such that munitions may be stored and thereafter quickly delivered on an as-needed basis to intermediate positions for the reloading of the weapon, comprising fore and aft multi-armed rotary support devices disposed in respective munitions storage bays immediately below deck level a spaced distance apart, which distance is less than the length of the munitions to be stored, the respective pairs of rotary support devices each having the same number of support arms, such that a like number of munitions disposed in a generally parallel array may reside between corresponding support arms of each of the fore and aft rotary support devices, the members of each pair of said rotary support devices being rotatable together, and having a common axis of rotation generally parallel to the centerline of the apparatus, independent means for driving each respective pair of rotary support devices in the inboard rotative direction during the loading of munitions into the respective storage magazine, and for driving said rotary support devices in the outboard direction during the delivery of the munitions to the deck level of the vehicle, and a respective munition transporter contained between the fore and aft rotary support devices constituting each pair of said rotary support devices, which munition transporter is spaced laterally from the axis of rotation of the respective rotary support device, each said munition transporter being in the form of an elevator having an upper and a lower operative position, such that it can selectively move munitions down to the respective pair of said multi-armed rotary support devices during the loading of the respective storage magazine, and up away from said multi-armed rotary support devices during the delivery of munitions for the loading of the weapon, each elevator, when in its lowered position, being located between circumferentially adjacent munition storage locations.

22. The rotary storage magazines as recited in claim 21 in which said multi-armed rotary support devices are of cruciform configuration.

23. The rotary storage magazines as recited in claim 21 in which said intermediate positions are on the deck, alongside the weapons to be reloaded.

24. The rotary storage magazine as recited in claim 21 in which releasable restraint arms are utilized upon the support arms of said rotary support devices, said restraint arms being normally closed, such that the munitions cradled in said support arms will not be dislodged during rotation of said rotary support devices.

25. The rotary storage magazine as recited in claim 24 wherein said restraint arms are open at the time when a munition is to be received, and means for automatically opening said arms when the munition is to be unloaded.

26. The rotary storage magazines as recited in claim 21 in which each said elevator is elongated generally parallel to the axes of rotation of the respective rotary support device, is operatively associated with an elongate deck opening, and serves to lift munitions therethrough one at a time to the deck level.

27. The rotary storage magazines as recited in claim 26 in which said elevator, when disposed at deck level, serves a distinct safety measure by substantially closing the deck opening, thus preventing any operator from falling into such opening.

28. The rotary storage magazines as recited in claim 26 in which a protective hatch cover normally covers each elongate deck opening when munitions are not being loaded or offloaded.

29. The rotary storage magazines as recited in claim 28 in which an interlock prevents said elevator, when loaded with a munition, from ascending when said protective hatch cover is closed.

30. The rotary storage magazines as recited in claim 26 in which a hingedly mounted lightweight cover is operationally associated with the elongate deck opening, such that it may serve as a closure therefor, said lightweight cover, when in a position closing said deck opening, being readily moved aside by a munition being lifted toward deck level by said elevator.

31. The rotary storage magazines as recited in claim 30 in which an electrical switch is operatively associated with and actuated by said lightweight cover, which electrical switch is a part of a circuit that, when actuated, serves to cause said elevator to go down, and said rotary storage device to rotate at the proper time, such that the next munition contained in said rotary storage magazine will be automatically positioned for thereafter being lifted to deck level.

32. The rotary storage magazines as recited in claim 26 in which releasable restraint arms are utilized with respect to each support arm of each of said rotary support devices, such that munitions will not be dislodged during rotation, the movement of said elevator serving to automatically effect release of said restraint arms at the appropriate instant during the loading procedure as well as during the offloading procedure.

33. The rotary storage magazines are recited in claim 26 in which interlock means utilized in connection with said elevator and rotary support devices serve to prevent said elevator from descending into contact with a munition supported by said rotary support devices.

34. The rotary storage magazines as recited in claim 26 in which interlock means utilized in connection with the drive for said rotary support device serves to prevent rotation of said device in the loading direction after their arms are full of munitions, or rotation thereof in the unloading direction after their arms have already been emptied of munitions.

35. The rotary storage magazines as recited in claim 26 in which separate control systems are utilized therewith, each control system including a control panel having a limited number of operator inputs thereon, which enable the operations of raising and lowering the elevator, and the rotation of the respective rotary support devices to be carried out in a properly interrelated manner, without undue intervention by the operator.

36. The rotary storage magazines as recited in claim 35 in which a foldable, lightweight closure member adjacent each elongate deck opening, said lightweight closure member, when moved to the position closing such deck opening, closing an electrical switch serving to bring about a certain sequence of operations, these including the downward movement of the elevator from the raised position, and the subsequent rotation of said rotary support devices in the direction serving to place the next munition upon said elevator.

37. The rotary storage magazines as recited in claim 26 in which a control system utilizing a plurality of limit switches is utilized to prevent damaging or undesired operation of either said elevator or said rotary support devices.

38. The ordnance apparatus as recited in claim 21 in which said munition transporters are operative in timed relation with the respective rotary support devices.

39. In an ordnance apparatus having a generally horizontally disposed deck, a munitions storage bay below the deck, and a weapon on the deck; a rotary storage magazine operably disposed in said munitions storage bay, so that munitions may be stored and thereafter quickly delivered on an as-needed basis to an intermediate position for the reloading of the weapon, means defining a generally rectangular opening in said deck, directly above a portion of said rotary storage magazine, said rotary storage magazine comprising multi-armed rotary support devices disposed in a fore and aft relationship immediately below deck level in said munitions storage bay, said rotary support devices being located a spaced distance apart, which distance is less than the length of the munitions to be stored, said rotary support devices each having the same number of support arms, such that a like number of munitions disposed in a generally parallel array may reside between corresponding support arms of the fore and aft rotary support devices, said rotary support devices being rotatably together, and having a common axis of rotation, that is disposed in substantial parallelism with the longitudinal centerline of the apparatus, means in said munitions storage bay for driving said rotary support devices in one rotative direction during the loading of munitions down through said deck opening into the storage magazine, and for driving said rotary support devices in the opposite direction during the upward delivery of the munitions for reloading of the weapon, and a munition transporter in the form of an elevator having upper and lower functional positions and operating entirely from a below-deck location, said munition transporter being disposed generally alongside said rotary support devices, and serving to move munitions down through said deck opening to said rotary support devices during the loading of the storage magazine, and up from said rotary support devices and through said rectangular deck opening during the delivery of munitions for the loading of the weapon, said elevator, when in its lowered position, being located between circumferentially adjacent munition storage locations.

40. In a vehicle or structure having a generally horizontal deck, a munitions storage bay below the deck, and a weapon on the deck, a rotary storage magazine usable so that munitions may be stored and thereafter quickly delivered on an as needed basis to an intermediate position for the reloading of a deck weapon, said rotary storage magazine comprising fore and aft multi-armed rotary support devices disposed below deck level in a munitions storage bay, said rotary support devices being located a spaced distance apart, which distance is less than the length of the munitions to be stored, said rotary support devices each having the same number of support arms, such that a like number of munitions disposed in a generally parallel array may reside between corresponding support arms of the fore and aft rotary support devices, said rotary support devices being rotatable together, and having a common axis of rotation disposed in substantial parallelism with the longitudinal centerline of the vehicle or structure, means in said munitions storage bay for driving said support devices in one rotative direction during the loading of munitions into the storage magazine, and for driving said rotary support devices in the opposite direction during the delivery of the munitions for reloading of the weapon, and a munition transporter usable for moving munitions to said multi-armed rotary support devices during the loading of the storage magazine, and away from said multi-armed rotary support devices during the delivery of munitions for the unloading of the weapon, said rotary support devices being mounted directly below an unbroken section of deck, and alongside an elongate lateral opening in the side of the vehicle or structure, and a munition transporter in the form of a below deck lateral conveyor serving to move munitions one at a time through said lateral opening during the loading of the storage magazine, and to redeliver munitions one at a time through said lateral opening during the phase in which the weapon is to be reloaded, the moving of munitions by said lateral conveyor being in a lateral direction spaced vertically from said axis of rotation of said rotary support devices between a munition storage location in said storage magazine and a location immediately outside said lateral opening, said lateral conveyor further serving to move munitions in a vertical direction between said outside location and a location at deck level.

41. The rotary storage magazine as recited in claim 40 in which a hinged closure member normally serves to close said elongate lateral opening, said closure member being supportable in a generally horizontal position during the phase involving the loading of the storage magazine, as well as during the offloading of the rotary storage magazine, when the weapon is being reloaded.

42. The rotary storage magazine as recited in claim 40 in which said rotary support devices are loaded as well as offloaded by said lateral conveyor engaging the ends of each munition to be moved, said lateral conveyor serving to lift each munition to the deck of the vehicle or structure at the time of the reloading of a weapon.

43. In a vehicle or structure having a generally horizontal deck, a pair of munitions storage bays below the deck, and at least one weapon on the deck, a pair of rotary storage magazines usable so that munitions may be stored and thereafter quickly delivered on an as needed basis to respective intermediate positions for the reloading of one or more deck weapons, said rotary storage magazines each including respective pairs of fore and aft multi-armed rotary support devices disposed below deck level in respective munitions storage bays, the rotary support devices of each pair being located a spaced distance apart, which distance is less than the length of the munitions to be stored, said rotary support devices each having the same number of support arms, such that a like number of munitions disposed in a generally parallel array may reside between corresponding support arms of each pair of fore and aft rotary support devices, the rotary support devices of each pair being rotatable together, and having a common axis of rotation disposed in substantial parallelism with the longitudinal centerline of the vehicle or structure, means in each of said munitions storage bays for driving the respective rotary support device in one rotative direction during the loading of munitions into the storage magazine, and for driving each said rotary support device in the opposite direction during the delivery of the munitions for reloading of the weapon, each pair of rotary support devices being mounted directly below an unbroken section of deck, and alongside an elongate lateral opening in the side of the vehicle or structure, and a respective munition transporter in the form of a below deck lateral conveyor serving to move munitions one at a time through said lateral opening during the loading of the storage magazine, and to redeliver munitions one at a time through said lateral opening during the phase in which the weapon is to be reloaded, the moving of munitions by each said lateral conveyor being in a lateral direction spaced vertically from said axis of rotation of said rotary support devices between a munition storage location in said storage magazine and a location immediately outside said lateral opening, each said lateral conveyor further serving to move munitions in a vertical direction between said outside location and a location at deck level.

44. The rotary storage magazine as recited in claim 43 in which a hinged closure member normally serves to close said elongate lateral opening, said closure member being supportable in a generally horizontal position during the phase involving the loading of the storage magazine, as well as during the offloading of the rotary storage magazine, when the weapon is being reloaded.

45. The rotary storage magazine as recited in claim 43 in which said rotary support devices are loaded as well as offloaded by said lateral conveyor engaging the ends of each munition to be moved, said lateral conveyor serving to lift each munition to the deck of the vehicle or structure at the time of the reloading of a weapon.

* * * * *

UNITED STATES PATENT AND TRADEMARK OFFICE

CERTIFICATE OF CORRECTION

PATENT NO. : 4,719,839

DATED : January 19, 1988

INVENTOR(S) : Paul W. Smothers, et al

It is certified that error appears in the above-identified patent and that said Letters Patent is hereby corrected as shown below:

On the title page assignee should read

-- Werkzeugmaschinenfabrik Oerlikon-Buhrle AG. --.

Signed and Sealed this

Thirtieth Day of August, 1988

*Attest:*

DONALD J. QUIGG

*Attesting Officer*

*Commissioner of Patents and Trademarks*